United States Patent [19]

Yoshida et al.

[11] 4,124,386

[45] Nov. 7, 1978

[54] COLOR DIFFUSION TRANSFER RECEIVING LAYER COMPRISING POLYMERIC QUATERNARY N-HETEROCYCLIC MORDANT

[75] Inventors: Takashi Yoshida; Takushi Miyazako, both of Minami Ashigara, Japan

[73] Assignee: Fuji Photo Film Co., Ltd., Minami Ashigara, Japan

[21] Appl. No.: 517,561

[22] Filed: Oct. 24, 1974

[30] Foreign Application Priority Data

Oct. 24, 1973 [JP] Japan ..... 48-119610

[51] Int. Cl.[2] ..... G03C 7/00; G03C 5/54; G03C 1/40

[52] U.S. Cl. ..... 96/29 D; 96/3; 96/77

[58] Field of Search ..... 96/3, 29 D, 77, 114, 96/84 A; 101/464

[56] References Cited

U.S. PATENT DOCUMENTS

| | | | |
|---|---|---|---|
| 2,484,430 | 10/1949 | Sprague et al. | 96/114 |
| 2,882,150 | 4/1959 | Allan et al. | 96/114 |
| 3,148,061 | 9/1964 | Haas | 96/77 |
| 3,698,896 | 10/1972 | Abbott et al. | 96/29 D |
| 3,709,690 | 1/1973 | Cohen et al. | 96/77 |
| 3,770,439 | 11/1973 | Taylor | 96/77 |
| 3,778,265 | 12/1973 | Land | 96/77 |
| 3,806,347 | 4/1974 | Ohyama et al. | 96/114 |
| 3,859,096 | 1/1975 | Burness et al. | 96/77 |
| 3,880,658 | 4/1975 | Lestina et al. | 96/77 |
| 3,898,088 | 5/1975 | Cohen et al. | 96/77 |

OTHER PUBLICATIONS

Ponticello et al, "Photographic Mordants" *Research Disclosure* #12045 4/1974.

*Primary Examiner*—Richard L. Schilling

*Attorney, Agent, or Firm*—Sughrue, Rothwell, Mion, Zinn and Macpeak

[57] ABSTRACT

An image-receiving layer of an image-receiving element used for a color diffusion transfer process comprising a dyeable polymer or mordant polymer having the structural unit represented by the formula (I)

(I)

wherein Z represents an atomic group necessary for completing a nitrogen-containing heterocyclic ring and $X^-$ represents a monovalent anion;

or represented by the formula (II)

(II)

wherein $R_1$ and $R_2$ each represents a hydrogen atom, an alkyl group, a hydroxyalkyl group, or an aralkyl group, and $X^-$ represents a monovalent anion and a color diffusion transfer process using the image-receiving element described above.

30 Claims, No Drawings

COLOR DIFFUSION TRANSFER RECEIVING LAYER COMPRISING POLYMERIC QUATERNARY N-HETEROCYCLIC MORDANT

BACKGROUND OF THE INVENTION

1. Field of the Invention

The present invention relates generally to color photography and more particularly it relates to a color diffusion transfer process. The invention further relates to an image-receiving element used for such a color diffusion transfer process.

2. Description of the Prior Art

In a color diffusion transfer process, a photosensitive element having photosensitive emulsion layers containing silver halide is imagewise exposed to form therein latent images and the latent images are developed by a processing solution to form, at the same time, an image-like distribution of color image-forming materials. Then, the image-forming materials are, at least partially, transferred to an image-receiving layer in a superposed relationship with the photosensitive element to form thereon a positive color image.

Examples of the color diffusion transfer process are the process as described in the specification of U.S. Pat. No. 2,983,606 in which developers, i.e., dyes which have the ability to develop silver halide and can develope exposed silver halides, are used as the color image-forming materials and a process as described in the specifications of U.S. Pat. Nos. 2,647,049 and 2,774,668 in which the phenomenon of the release of color image-forming materials on development of latent images with a color developing agent is utilized. The image-receiving element used in such processes is usually an opaque or transparent support having formed thereon an image-receiving layer containing a water-permeable and alkali solution-permeable polymer mordant. Examples of polymer mordants are poly-4-vinylpyridine as described in the specification of U.S. Pat. No. 3,148,061 and the various vinylic quaternary salt polymers as described in the specification of British Patent No. 1,261,925.

SUMMARY OF THE INVENTION

It has now been discovered that the polymers as specified below are particularly useful as a mordant for color image-forming materials.

An object of this invention is to provide a color diffusion transfer process wherein these polymers are used as the polymer mordant.

Another object of this invention is to provide a color diffusion transfer image-receiving material having an image-receiving element containing these polymers as a polymer mordant.

That is, the present invention provides an image-receiving layer for a color diffusion transfer process containing a polymer mordant having therein at least one of the structures represented by the general formal (I)

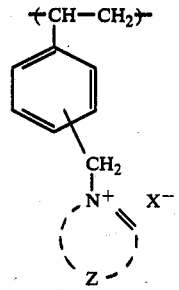

(I)

wherein Z represents an atomic group necessary for completing a nitrogen-containing heterocyclic ring; and $X^-$ represents a monovalent anion;

or represented by the general formula (II)

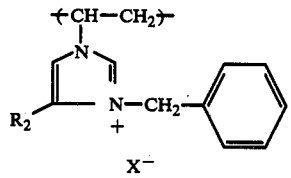

(II)

wherein $R_1$ and $R_2$ each represents a hydrogen atom, an alkyl group, a hydroxyl group, or an aralkyl group; and $X^-$ represents a monovalent anion.

According to another embodiment of this invention, a color diffusion transfer process is further provided using as an image-receiving element, a layer containing the polymer mordant having the structure unit represented by the general formulae (I) and (II) as described above.

DETAILED DESCRIPTION OF THE INVENTION

The image-receiving layer of this invention is particularly preferred in the color diffusion transfer process wherein dye developers are employed. For instance, the use of the image-receiving element provides a particularly remarkable improvement, such as for color density in the case of using azoic and anthraquinonic dye developers.

The dye developer described above is a compound having, in the same molecule, a dye coupling moiety and a silver halide developing group. The dye developer can be further defined as a dye which is a silver halide developing agent. The term "silver halide developing group" designates a group which can develop (reduce) exposed silver halide. Particularly useful due developers are dye developers in which the silver halide developing group has a benzenoid developing group. An example of a preferred benzenoid group in such a compound is a hydroquinonyl group. Typical examples of dye developers are described in the specification of U.S. Pat. No. 2,983,606. Also, other useful dye developers are disclosed in the specification of Japanese Patent No. 252,111.

In the color diffusion transfer process in which dye developers are used, silver halide latent images in a photosensitive element are developed in the presence of dye developers, whereby the dye developers in the exposed areas are oxidized by the development and are substantially fixed. It is believed the fixing of the dye developers is, at least partially, dependent upon the change in the solubility characteristics of the dye developer, in particular the change relative to the solubility of the dye developer in an alkaline aqueous solution. Since the due developers in the unexposed and partially exposed areas of the silver halide emulsions are unreacted and diffusible, an image-like distribution of the unoxidized dye developers is provided in a liquid processing composition as a function of the exposure extent of the silver halide emulsions. The image-like distribution of the unoxidized dye developers is, at least partially, transferred by imbibition to a superposed image-receiving layer. The transfer substantially does not occur with the oxidized dye developers. The image-receiving element receives the image-like diffusion of the unoxidized dye developers from the developed silver halide emulsion layers without substantially disturbing the image-like distribution of the unoxidized dye developers.

The invention is explained below in greater detail. The image-receiving element for the color diffusion transfer process of this invention essentially comprises a support having thereon an image-receiving layer capable of mordanting dyes and the image-receiving element, more preferably, comprises a support having thereon in succession an acid polymer layer for neutralization, a neutralization rate controlling layer, and the image-receiving layer capable of mordanting dyes.

Examples of suitable supports which can be used for the image-receiving element are a baryta-coated paper, a paper coated with a resin such as polyethylene, a sheet of a cellulose organic acid ester such as diacetyl cellulose, triacetyl cellulose, cellulose acetate butyrate; a sheet of a poly ester such as polyethylene terephthalate or a polyvinyl compound such as polyvinyl acetate; a sheet of a polyvinyl acetal such as polyvinyl acetal; and a sheet of a polyolefin such as polystyrene, polypropylene and polyethylene.

As the material used for the above-described acid layer for neutralization, a film-forming acid polymer having at least one of a carboxyl group, sulfo group, or a group capable of forming a carboxyl group by hydrolysis is preferred and any acid polymers having the aforesaid characteristics can be used in this invention. The acid polymers used in this invention preferably have a molecular weight of from about 10,000 to about 100,000. Specific examples of such acid polymers are the monobutyl ester of a 1:1 molar ratio copolymer of maleic anhydride and ethylene and the monobutyl ester of a 1:1 molar ratio copolymer of maleic anhydride and methyl vinyl ether as described in the specification of U.S. Pat. No. 3,362,819. Other specific examples of acid polymers which can be used in this invention are the monoethyl ester, monopropyl ester, monopentyl ester, and monohexyl ester of a 1:1 molar ratio copolymer of maleic anhydride and ethylene; the monoethyl ester, monopropyl ester, monopentyl ester, and monohexyl ester of a 1:1 molar ratio copolymer of maleic anhydride and methyl vinyl ether; various copolymers of acrylic acid and methacrylic acid in various ratios; polyacrylic acid; polymethacrylic acid; and various copolymers of acrylic acid or methacrylic acid and other vinylic monomers in various ratios, for instance a copolymer of at least 30 mole percent, preferable 50 to 90 mole percent of acrylic acid of methacrylic acid and an acrylic acid ester, a methacrylic acid ester, or a vinyl ether.

Such an acid polymer is coated on a support as a solution thereof in an alcohol such as methanol, ethanol, propanol, butanol, etc., a ketone such as acetone, methyl ethyl ketone, diethyl ketone, cyclohexanone, etc., an ester such as methyl acetate, ethyl acetate, isopropyl acetate, butyl acetate, etc., or a mixture thereof.

Since the thickness of the acid layer for neutralization depends on the composition and the amount of an alkaline processing composition used and the property of the material used for the acid layer, the thickness cannot be defined unequivocally but in general a thickness of about 5 to 30 microns is appropriate.

With respect to the layer configuration, the acid layer for neutralization is disposed under an image-receiving layer. The acid material or polymer contributes to the neutralization of the alkali in the liquid processing composition contained in the image-receiving layer. Therefore, the diffusibility of the dye developers diffused from the photosensitive element can be reduced or eliminated in the image-receiving layer and thus the dye developers can be effectively mordanted in the image-receiving layer.

Between the image-receiving layer and the acid layer for neutralization, a spacer layer or a neutralization rate controlling layer for controlling the release of the acid material can be formed.

Examples of polymers which can be used for such a spacer layer are polymers of polyvinyl alcohol and polymers of a partially acetalated polyvibyl alcohol as described in the specification of U.S. Pat. No. 3,362,819. Other examples of polymers are polymers such as gelatin and polyacrylamide graft copolymers as described in the specification of U.S. Pat. No. 3,575,701. Furthermore, the alkali solution-permeable and water-permeable homopolymers, copolymers, or graft polymers of a monoacrylic acid ester and/or a monomethacrylic acid ester of a polyhydric alcohol can be also used as the polymer for the spacer layer.

Any polyhydric alcohols can be used for the above-described polymers if the final polymers are alkali solution-permeable and water-permeable but polyhydric alcohols providing particularly preferred results are alcohols having at least two aliphatic hydroxyl groups. More preferred polyhydric alcohols are alcohols having 2 to 5 aliphatic hydroxyl groups and 2 to 12 carbon atoms. Specific examples of such polyhydric alcohols are diols such as ethylene glycol, propylene glycol, 1,4-propanediol, 1,3-dihydroxy-2,2-dimethylmethane, 1,5-dihydroxypentane, polyethylene glycol, polypropylene oxide, polybutylene oxide, polycyclohexene oxide, polystyrene oxide, polyoxetane, polytetrahydrofuran, cyclohexanediol, xylylenediol, di-($\beta$-hydroxyethoxy)benzene, etc., and polyols such as glycerin, diglycerin, trimethylolpropane, triethylolpropane, pentaerythritol, etc.

Also, specific examples of monoacrylic acid esters of polyhydric alcohols and monomethacrylic acid esters of polyhydric alcohols are 2-hydroxyethyl methacrylate, 3-hydroxypropyl methacrylate, 2-hydroxypropyl methacrylate, 4-hydroxybutyl methacrylate, 5-hydroxypentyl methacrylate, 2,2-dimethyl-3-hydroxypropyl methacrylate, diethylene glycol monomethacrylate, trimethylolpropane monomethacrylate, pentaerythritol monomethacrylate, 2-hydroxyethyl acrylate, 3-hydroxypropyl acrylate, 2-hydroxypropyl acrylate, 4-hydroxybutyl acrylate, 5-hydroxypentyl acrylate, 2,2-dimethyl-3-hydroxypropyl acrylate, diethylene glycol monoacrylate, tiemethylolpropane monoacrylate, pentaerythritol monoacrylate, etc.

Any addition polymerizable monomers can be used as a comonomer to be copolymerized with the monoacrylate or the monomethacrylate of the polyhydric alcohol as illustrated above but a monomer having a vinyl group or a vinylidene group is particularly preferred. Examples of such monomers are, for instance, an acrylamide and methacrylamide such as acrylamide, methacrylamide, diacetone acrylamide, acroylmorpholine, etc., an alkyl acrylate and alkyl methacrylate such as methyl acrylate, ethyl acrylate, propyl acrylate, propyl methacrylate, chloroethyl acrylate, chloroethyl methacrylate, butyl acrylate, pentyl methacrylate, hexyl acrylate, hexyl methacrylate, etc., a vinyl ester such as vinyl acetate, vinyl butyrate, vinyl propionate, vinyl benzoate, etc., a vinyl ether such as chloroethyl vinyl ether, butylvinyl ether, etc., a styrene such as styrene, chlorostyrene, methoxystyrene, methylstyrene, chloromethylstyrene, dichlorostyrene, etc., acrylonitrile, methacrylonitrile, vinylpyrrolidone, vinylimidazole, vinyl chloride, vinylidene chloride, methyl vinyl ketone, vinylpyridine, vinylmethylpyridine, vinylethylpyridine, vinylmethylimidazole, and further the diacylate or dimethacrylate of the aliphatic polyhydric alcohols as described above. These monomers can be copolymerized with the aforesaid monoacrylic acid ester or monomethacrylic acid ester individually or as a combination of two or more monomers.

The copolymerization ratio is such that the proportion of the monoacrylic acid ester or monomethacrylic acid ester is greater than about 50 mole percent, preferably greater than 60 mole percent. The molecular weight of the copolymer is usually higher than about 10,000, more preferably in the range of 50,000 to 600,000.

Also, preferred examples of polymers to be grafted with the above described monoacrylic acid ester or monomethacrylic acid ester or monomethacrylic acid ester are gelatin, polyvinyl alcohol, polyacrylamide, carboxymethyl cellulose, starch, and hydroxyethyl cellulose.

These polymers are coated as a solution in a solvent and particularly preferable examples of suitable solvents are ethanol, methyl ethyl ketone, a mixed solvent of methanol and water, a mixed solvent of ethanol and water, a mixed solvent of propanol and water, a mixed solvent of acetone and water, and a mixed solvent of methyl ethyl ketone and water. When the above described mixed solvent is used, it is preferred that the proportion of water range from about 20 to 80% by volume. The thickness of the spacer layer is usually about 3 to 20 microns but it can be varied depending on the purpose.

The polymer mordant for the image-receiving layer which is a most important feature in this invention is explained below. The polymer mordant used in this invention is a compound having therein the structural unit represented by general formula (I)

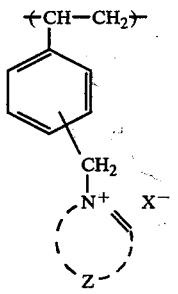

(I)

wherein Z represents an atomic group necessary for completing a nitrogen-containing heterocyclic ring, and $X^-$ represents a monovalent anion; or represented by the general formula (II)

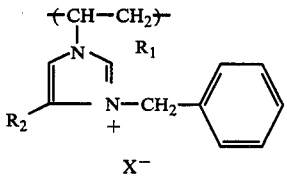

(II)

wherein $R_1$ and $R_2$ each represents a hydrogen atom, an alkyl group, a hydroxyl group, or an aralkyl group, and X— represents a monovalent anion.

Specific examples of nitrogen-containing heterocyclic rings completed by Z are, for instance, pyridine, α-picoline, β-picoline, γ-picoline, 2-ethylpyridine, 3-ethylpyridine, 4-ethylpyridine, 3-butylpyridine, 3-benzylpyridine, 4-β-phenylethylpyridine, 4-β-(4-methoxyphenyl)ethylpyridine, 4-β-(4-hydroxy-3-methoxyphenyl)ethylpyridine, 3,5-lutidine, 3-ethyl-4-methylpyridine, quinoline, 3-methylquinoline, 3,4-dimethylpyinoline, 7-chloro-3-methylquinoline, 2,4,6-trimethylquinoline, 1,2-bis-(4-pyridyl)ethane, 3-bromopyridine, 4-(p-chlorobenzyl)pyridine, γ-corydine, 2,3,6-corydine, 2,6-lutidine, 3,4-lutidine, 3,5-lutidine, 2,3-lutidine, 2,4-lutidine, 2,5-lutidine, 2,5-dichloropyridine, 4,4'-dipyridyl, 4-phenylpyridine, isoquinoline, phenanthridine, 4-methanolpyridine, 3-acetylaminopyridine, 1,4-pyrimidine, 1,2-pyrimidine, 1,3-pyrimidine, 2-methyl-1,4-pyrimidine, benzopyrimidine, s-triazine, 1,2-dimethylimidazole, 1-ethyl-2-methylimidazole, 2-methylbenzothiazole, 2-methylnaphthothiazole, etc, Also, preferably the alkyl group, the hydroxyalkyl group or the aralkyl group represented by $R_1$ or $R_2$ in general formula (II) has 1 to 10 carbon atoms. Specific examples of suitable alkyl groups are a methyl group, an ethyl group, a propyl group, an isopropyl group, an n-butyl group, an iso-butyl group, an n-pentyl group, an isopentyl group, an n-hexyl group, etc. Suitable examples of hydroxyalkyl groups are a hydroxyethyl group, a hydroxypropyl group, a hydroxybutyl group, a hydroxypentyl group, a hydroxyhexyl group, a hydroxyoctyl group, a hydroxydecyl group, etc. Suitable examples of aralkyl groups are a benzyl group and a phenethyl group.

The monovalent anion represented by $X^-$ in general formulae (I) and (II) is preferably a photographically inert ion such as a chlorine ion, a bromine ion, an iodine ion, a nitrate ion, an alkylsulfate ion, etc., but a particular preferred anion is a halogen ion and a most preferred anion is a chlorine ion.

The polymer having the above described structural unit can be a homopolymer of repeating units of the structure (I) or (II) alone as well as can be a copolymer with other vinylic monomers or graft polymers containing the above described structural units (I) and/or (II).

Examples of vinylic comonomers which can used for the aforesaid copolymer containing the structural unit (I) and/or (II) are acrylamide, methacrylamide, ethyl acrylate, methyl methacrylate, ethyl methacrylate, n-propyl acrylate, n-propyl methacrylate, iso-propyl acrylate, iso-propyl methacrylate, n-butyl acrylate, n-butyl methacrylate, acrylonitrile, methacrylonitrile, styrene, methylstyrene, chloromethylstyrene, vinyl chloride, vinylidene chloride, hydroxyethyl acrylate, hydroxyethyl methacrylate, 3-hydroxypropyl acrylate, 3-hydroxypropyl methacrylate, vinyl acetate, etc. The above described structural unit (I) and/or (II) can be present at any desired proportion in the copolymer but the proportion is preferably higher than about 10 mole percent, more preferably higher than 20 mole percent. The comonomer can be employed as a single monomer or a combination of comonomers can be used.

Preferred examples of the polymer to which the polymer having the aforesaid structural unit (I) and/or (II) is grafted are gelatin, polyvingyl alcohol, polyacrylamide, carboxymethyl cellulose, starch, hydroxyethyl cellulose, etc. Suitable proportions of the polymer having the structural formula (I) and/or (II) which can be grafted to these polymers are in the range of from about 5 to about 40% by weight based on the weight of the latter polymers.

The molecular weight of the polymer mordant used in this invention is preferably about 10,000 to 500,000, particularly preferably in the range of 10,000 to 200,000.

Specific examples of the polymer mordant having the structural unit represented by general formula (I) are illustrated below:

Polymer I-1:

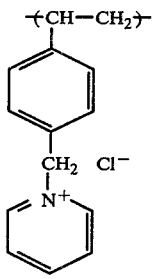

Polymer I-2:

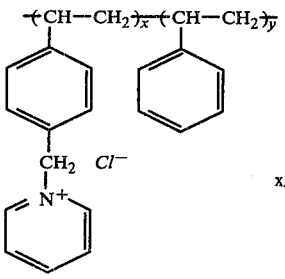

x/y = 50/50

Polymer I-3:

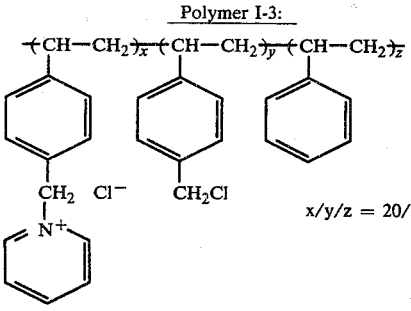

x/y/z = 20/30/50

Polymer I-4:

-continued

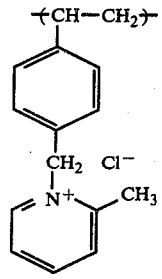

Polymer I-5:

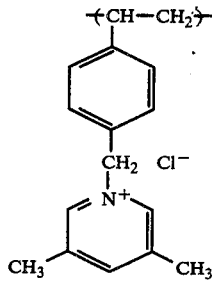

Polymer I-6:

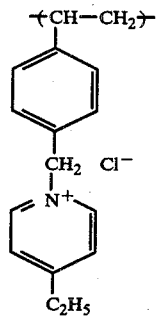

Polymer I-7:

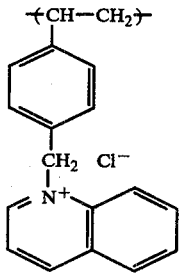

Polymer I-8:

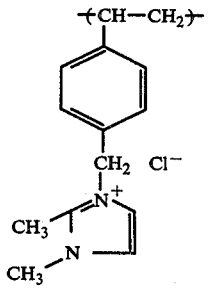

Polymer I-9:

-continued

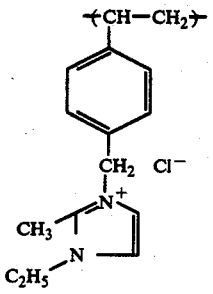

Polymer I-10:

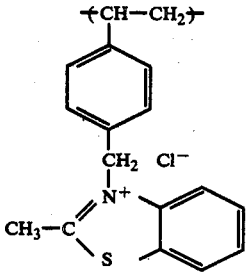

Also, specific examples of the polymer mordant having the structural unit represented by general formula (II) are illustrated below:

Polymer II-1:

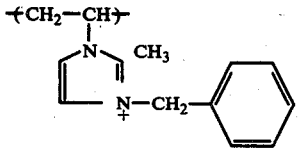

Polymer II-2:

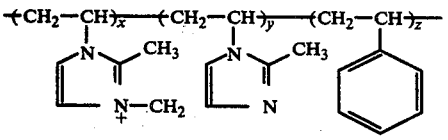

x/y/z=20/30/50

Polymer II-3:

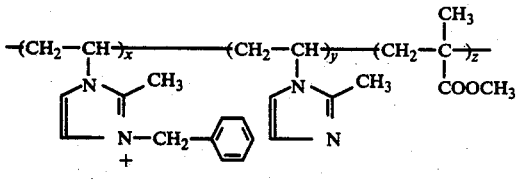

x/y/z=30/30/40

Polymer II-4:

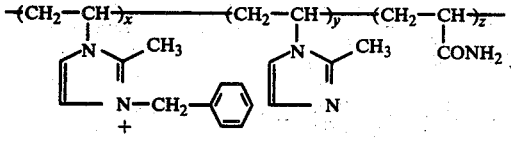

x/y/z=40/40/20

Polymer II-5:

-continued

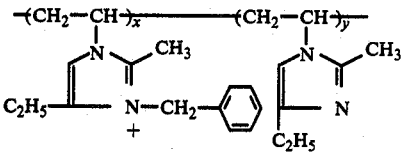

x/y=30/70

Polymer II-6:

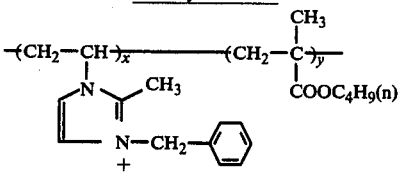

x/y=40/60

Polymer II-7:

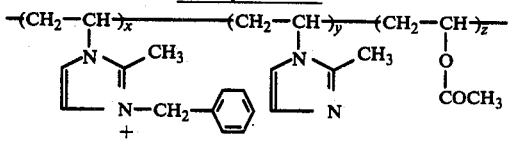

x/y/z=30/50/20

Polymer II-8:

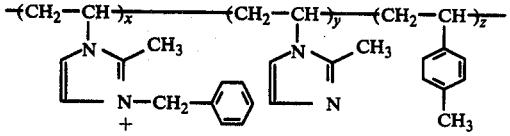

x/y/z=20/50/30

Polymer II-9:

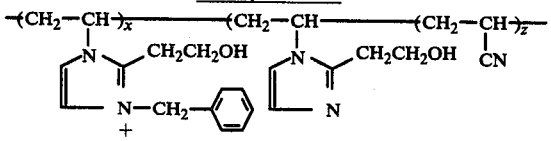

x/y/z=30/20/50

Polymer II-10:

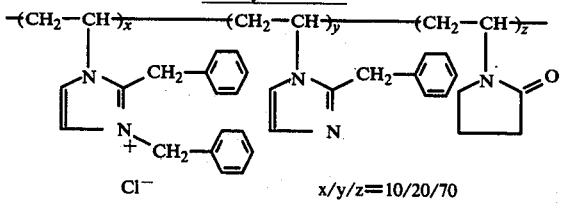

x/y/z=10/20/70

The polymer mordant having the structural unit represented by general formula (I) can be prepared by reacting a homopolymer, copolymer, or graft polymer of a halomethylstyrene, preferably a homopolymer, copolymer, or graft polymer of chloromethylstyrene, and a heterocyclic compound or by quaternizing the monomer with a heterocyclic compound and then polymerizing the product.

On the other hand, the polymordant having the structural unit represented by general formula (II) can be prepared by polymerizing a quaternized N-vinylimidazole or copolymerizing the quaternized N-vinylimidazole with a vinylic monomer such as styrene. Or, further, the polymer mordant can be readily prepared by reacting a homopolymer of N-vinylimidazole or a copolymer of N-vinylimidazole and a vinylic monomer such as styrene, methyl methacrylate, and N-vinylpyrrolidone with a benzyl halide in a solvent such as dimethylformamide, dioxane, or ethanol.

The polymer mordant used in this invention is appropriately coated on a support, having the acid polymer layer and the spacer layer coated thereon, as a solution of the polymer mordant in a concentration of about 2 to 20% but the polymer mmordant solution can be coated directly on the support without preliminary forming the acid polymer and the spacer layer thereon. Alternatively, the layer of the polymer mordant need not be formed preliminarily on the support and a solution of the polymer mordant can be applied on the surface of the support simultaneously when a liquid processing composition is spread thereover at development. Since the polymer mordant used in this invention is soluble in water, the mordant can be coated as an aqueous solution thereof and can be coated as a solution thereof in an organic solvent such as methanol, ethanol, acetone, methyl ethyl ketone, a mixture thereof, or a mixture of such an organic solvent and water.

The polymer mordant used in this invention can form a dyeable film per se and can be used together with a water-soluble polymer such as gelatin, polyvinyl alcohol, carboxymethyl cellulose, hydroxyethyl cellulose, starch, polyacrylamide, polyvinyl pyrrolidone, etc. In using the polymer mordant together with the water/-soluble polymer, various mixing ratios can be used but suitably the polymer mordant is present in the image-receiving layer in an amount of about 10 to 100% by weight. The thickness of the image-receiving layer can be selected appropriately depending on the purpose but an optimum thickness thereof is about 3 to 10 microns. The polymer mordant used in this invention provides an even better result when it is used together with polyvinyl alcohol.

The image-receiving element described above is superposed on a photosensitive element for color diffusion transfer in a face-to-face relationship, the silver halide emulsion layers exposed are developed by spreading an alkaline processing solution between the image-receiving element and the photosensitive element, and thus the dye image-forming materials formed by the reaction of the dye developers and the silver halide or by the reaction of the couplers and the oxidation products of color developers are transferred to the image-receiving layer in an image-like distribution.

The photosensitive element for a color diffusion transfer process comprises a support having thereon at least one silver halide emulsion layer and a dye image-forming material associated with the silver halide in the silver halide emulsion layer. In particular, the photosensitive element preferably comprises a support having thereon in succession from the support a red sensitive silver halide emulsion layer, a green seensitive silver halide emulsion layer, and a blue sensitive silver halide emulsion layer having, respectively, a cyan dye-forming material, a magenta dye-forming material, and a cyan dye-forming material associated with each emulsion layer. Also, if desired, layers such as a yellow filter layer, an antihalation layer, intermediate layers, and a protective layer can be formed on the support.

The support for the photosensitive element is a sheet-like material which does not undergo great dimensional change on contact with a liquid alkaline processing composition during the processing period of time. According to the purpose, a rigid support such as a glass sheet can be used but in general a flexible support is useful. Suitable flexible supports are the supports used generally for photographic light-sensitive materials. Examples of such supports are a cellulose nitrate film, a cellulose acetate film, a polyvinyl acetal film, a polystyrene film, a polyethylene terephthalate film, a polycarbonate film, etc. A dimensionally stable and oxygen-imperious support of, e.g., a polyvinyl alcohol layer sandwiched between polyethylene terephthalate layers or cellulose acetate layers is particularly desirable since the dye image formed has good stability and the formation of stains is less. Also, a vapor permeable support as described in the specification of U.S. Pat. No. 3,573,044 can be advantageously used for assisting the evaporation of water of the spread liquid processing composition through the support after processing.

To prevent the exposure of the silver halide emulsion layer or layers to light through the edge of the transparent support in processing the film unit in a bright place, the transparent support desirably is colored to such an extent that the imagewise exposure and the observation of the formed image are not obstructed but the transmission of light in the planar direction of the support can be prevented. If desired, the support can contain a plasticizer such as a phthalic acid ester, a ultraviolet absorbent such as 2-(2-hydroxyl-4-t-butylphenyl)benztriazole, and an antioxidant such as hindered phenol. To improve the adhesive property between the subbing layer and the support, a pretreatment such as a corona discharge, ultraviolet irradiation, and flame treatment advantageously is applied to the surface of the support. The thickness of the support is usually about 20 to 300 microns.

The dye image-forming material is a compound which provides a two-dimensional distribution of a diffusible dye corresponding to the imagewise exposure of the silver halide emulsion layer as the result of the development of the silver halide emulsion. Various types of dye image-forming materials based on various systems leading to the generation of diffusible dyes as the result of the development of silver halide are known. For instance, there are the types wherein the oxidation of silver halide directly provides a diffusible dye, such as, (I) a type where the diffusibility of the dye image-forming material changes as the result of the oxidation of the dye image-forming material by silver halide, (II) a type where a diffusible dye is generated or released by the reaction of the oxidation product of color developer and the dye image-forming material, and (III) a type where the oxidized dye image-forming material is reacted with an auxiliary agent to release the diffusible dye. There are also types wherein the image of a diffusible dye is formed using, as the source, a component remaining and not consumed by the development and a succeeding reaction to the development such as (IV) a type where a definite amount of a developing agent is used and the developing agent which is not used in the development is transferred to the image-receiving layer to provide a dye therein, (V) a type where a definite amount of a developing agent is used and the developing agent which is not used in the development reacts with the dye image-forming material to provide a diffusible dye, (VI) a type where a definite amount of a reactive component which reacts with the oxidation product of a developing agent, such as a coupler, is used and the reactive component remaining and not consumed in a succeeding reaction to the development is transferred to the image-receiving layer to form a dye therein, and (VII) a type where a diffusible dye is formed by the reaction of silver ions obtained from silver halide which was not used in the development and a dye image-forming material. Furthermore, there is (VIII) a type where a mordant is formed or destroyed around the silver halide grains by the development of the silver halide grains, whereby a diffusible dye is fixed or released.

The dye image-forming material can contain a completed dye structure moiety, or the dye structure moiety can be formed in the step of development or in a step succeeding the development occuring simultaneously therewith, or further a component necessary for the formation of dye is transferred to the image-receiving layer to form the dye there.

Desirably the dye image-forming material is non-diffusible in the photosensitive element during the production of the photosensitive material, storage of the photosensitive material, and in the step of exposure of the photosensitive material but the dye image-forming material can have a varying degree diffusibility depending on the system of the formation of the imagewise distribution of the dye in the step of development and the step of diffusion transfer. For instance, in one example a dye image-forming material which is soluble and diffusible in a liquid processing composition is reduced in diffusibility and fixed as the result of development and the part of the dye image-forming material which was not developed is transferred to the image-receiving layer and in another example the dye image-forming material itself is non-diffusible in a liquid processing composition but releases a diffusible dye or a precursor for the diffusible dye as the result of development.

In this invention, the dye image-forming materials of the various combinations of the conversion system from development to dye, the steps of the formation of the dye structure moieties, and diffusibility as described above can be used, but particularly useful dye image-forming material are as follows:

(a) Dye Developers

A dye developer is a compound having a dye structure moiety and a silver halide developing agent in the same molecule as disclosed in the specification of U.S. Pat. No. 2,983,606. When an exposed silver halide emulsion reacts with the dye developer and an alkali, the reduction of the silver halide and the oxidation of the dye developer occur. The oxidized dye developer has a low solubility and diffusibility in a liquid processing composition as compared with the original dye developer in a reduced form and is fixed near the reduced silver halide grains. In a preferred form, the dye developer has at least one dissociable residue capable of rendering the dye developer soluble and diffusible in an alkaline processing solution, with the dye developer being substantially insoluble in an acid or neutral aqueous medium. Such a dye developer can be incorporated in a photosensitive element, in particular in the silver halide emulsion layer or a layer adjacent the silver halide emulsion layer and when the dye developers are transferred by diffusion to an image-receiving element from a photosensitive element having two or more photosensitive units comprising combinations of silver halide emulsions sensitized to different spectral wave length regions and dye developers having spectral absorption characteristics corresponding to the photosensitive wave length regions, a multicolor positive image can be obtained in one development. It is advantageous to use dye developers having light absorption characteristics capable of reproducing colors by subtractive color process, that is, dye developers capable of providing yellow, magenta, and cyan dyes, respectively. The dye structure moiety providing such an absorption can be derived from an azo dye, an anthraquinone dye, a phthalocyanine dye, a nitro dye, a quinoline dye, an azomethine dye, an indamine dye, an indoaniline dye, an indophenol dye, or an azine dye.

On the other hand, the silver halide developing group designates a group capable of developing exposed silver halide, preferably a group whose hydrophilic property is destroyed as the result of oxidation. In general, a benzenoid developer group, that is, an aromatic developer group which can form a quinoid structure when it is oxidized is suitably used. A preferred developer group is hydroquinonyl group and other examples of the appropriate developer groups are an o-dihydroxyphenyl group and o- and p-amino-substituted hydroxyphenyl groups. In a preferred dye developer, the dye structure moiety is separated from the developer group by a saturated aliphatic group, such as an ethylene group, so that conjugation is prevented. In particular, a 2-hydroquinonylethyl group and a 2-hydroquinonylpropyl group are useful. The dye structure moiety can be connected to the dye developer group by a covalent bond or can be connected to the dye developer group by a coordinate bond as disclosed in the specifications of U.S. Pat. Nos. 3,551,406; 3,563,739; 3,597,200; and 3,674,478. Furthermore, depending on the purpose and the constitution of the diffusion transfer color photographic material, a dye structure moiety which has been temporarily converted into a colorless leuco form by reduction as disclosed in the specification of U.S. Pat. No. 3,320,063 or in which the hydroxyl group or the amino group of the auxochrone has been acylated to shift temporarily the absorption to a short wave length side as disclosed in the specifications of U.S. Pat. Nos. 3,230,085 and 3,307,947 is advantageous. In another embodiment, a dye developer having the dye structure moiety having a hydroxyl group at the o-position of the azo bond is advantageously used in that the absorption characteristics and the stability of the color image formed are superior as described in the specification of U.S. Pat. No. 3,299,041.

Other dye developers suitable for use in diffusion transfer color photography are described in the specifications of U.S. Pat. Nos. 2,983,605; 2,983,606; 2,992,106; 3,047,386; 3,076,808; 3,076,820; 3,077,402; 3,126,280; 3,131,061, 3,134,762; 3,134,765; 3,135,604; 3,135,605; 3,135,606; 3,135,734; 3,141,772; 3,142,565; 3,218,164; 3,230,082; 3,230,083; 3,239,339; 3,320,063; 3,453,107; 3,579;334; 3,482,972; and 3,563,739; Australian Patent No. 220,279; German Patent No. 1,036,640; British Patent Nos. 804,971; 804,973; 804,974; and 804,975; Belgian Patent Nos. 554,935 and 568,344; Canadian Patent Nos. 579,038 and 577,021; French Patent No. 1,168,292; etc.

The dye developers are characterized in that they are slightly soluble in water and non-diffusible under acidic and neutral conditions and they are diffusible under alkaline condition.

Representative examples of the dye developers include the following compounds.

1-Phenyl-3-N-n-hexylcarbamoyl-4-p-(2-hydroquinonylethyl)-phenylazo-5-pyrazolone 2-p-(2-Hydroquinonylethyl)-phenylazo-4-isopropoxy-1-naphthol 1,4-bis[β-(Hydroquinonyl-isopropyl)amino]-5,8-dihydroxyanthraquinone 1-Phenyl-3-n-butyl-carbamoyl-4-[p-(2′,5′-dihydroxyphenethyl)phenylazo]-5-pyrazolone 1-Phenyl-3-N-n-hexylcarbamoyl-4-[p-(2′,5′-dihydroxyphenethyl)phenylazo]-5-pyrazolone 1-Phenyl-3-carbethoxy-4-[p-(2′,5′-dihydroxyphenethyl)phenylazo]-5-pyrazolone 2-[p-(2′,5′-Dihydroxyphenethyl)phenylazo]-4-isopropoxy-1-naphthol 1-Phenyl-3-N-cyclohexylcarbamoyl-4-[p-(2′,5′-dihydroxyphenethyl)phenylazo]-5-pyrazolone 1-Phenyl-3-phenyl-4-[p-(2′,5′-dihydroxyphenethyl)-phenylazo]-5-pyrazolone 1-Phenyl-3-amido-4-{4′-[p-(2″,5″-dihydroxyphenethyl)phenylazo]-2′,5′-diethoxyphenylazo}-5-pyrazolone 1-Phenyl-3-N-cyclohexylcarbamoyl-4-[p-(2′,5′-dihydroxyphenyl)phenylazo]-5-pyrazolone 1-Phenyl-3-phenyl-4-[p-(2′,5′-dihydroxyphenethyl)-phenylazo]-5-pyrazolone 1-Phenyl-3-methyl-4-[p-(2′,5′-dihydroxyphenethyl)-phenylazo]-5-pyrazolone 1-Phenyl-3-(N-n-heptyl)carbamoyl-4-[p-(β-hydroquinonylethyl)phenylazo]-5-pyrazolone 1-(2′-Chlorophenyl)-3-(N-n-hexylcarbamoyl)-4-[p-(β-hydroquinonylethylphenylazo]-5-pyrazolone

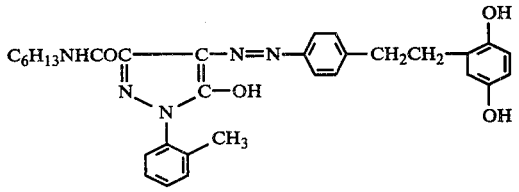

1-Acetoxy-2-[p-(β-hydroquinonylethyl)-phenylazo]-4-methoxynaphthalene

4-Isobutoxy-2-[p-(β-hydroquinonylethyl)-phenylazo]-1-naphthol 2-4′-[p-(2″,5″-Dihydroxyphenethyl)-phenylazo]-α-naphthylazo-4-methoxy-1-naphthol 2-{4′-[p-(2″,5″-Dihydroxyphenethyl)-phenylazo]-α-naphthylazo}-4-methoxy-1-naphthol 4-[p-(2′,5′-Dihydroxyphenyl)-phenylazo]-5-acetamido-1-naphthol 4-[p-(2′,5′-Dihydroxyphenethyl)-phenylazo]-5-benzamido-1-naphthol 2-[p-(2′,5′-Dihydroxy-4′-methylphenethyl)-phenylazo]-4-propoxy-1-naphthol 2-[p-(2′,5′-Dihydroxyphenethyl)-phenylazo]-4-acetamido-1-naphthol 2-[p-(2′,5′-Dihydroxyphenethyl)-phenylazo]-4-methoxy-1-naphthol 2-[p-(2′,5′-Dihydroxyphenethyl)-phenylazo]-4-ethoxy-1-naphthol 2-[p-(2′,5′-Dihydroxyphenethyl)-phenylazo]-4-n-propyl-1-naphthol

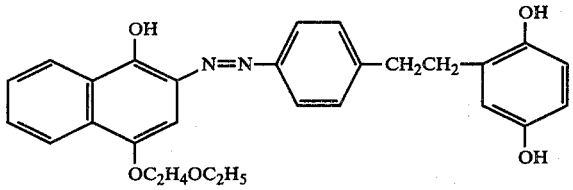

1,4-bis[β-(2′,5′-Dihydroxyphenyl)ethylamino]anthraquinone

1-Chloro4-[β-(2′,5′-dihydroxyphenyl)ethylamino]anthraquinone

N-Monobenzol-1,4-bis[β-(3′,4′-dihydroxyphenyl)ethylamino]anthraquinone

N-Monobenzol-1,4-bis[β-(2′,5′-dihydroxyphenyl)ethylamino]anthraquinone 5,8-Dihydroxy-1,4-bis[(β-hydroquinonyl-α-methyl)ethylamino]anthraquinone 1,4-bis(2′,5′-Dihydroxyaniline)anthraquinone 1,5-bis(2′,5′-Dihydroxyaniline)-4,8-dihydroxyanthraquinone 1,4-bis[(β-Hydroquinonyl-α-ethyl)ethylamino]-anthraquinone 5-Hydroxy-1,4-bis[(β-hydroquinonyl-α-methyl)ethylamino]anthraquinone 1-(β-Hydroxy-α-ethyl-ethylamino)-4-(β-hydroquinonyl-α-methyl-ethylamino)anthraquinone 1-(Butanol-2′-amino)-5,8-dihydroxy-4-hydroquinonylisopropylamino-anthraquinone

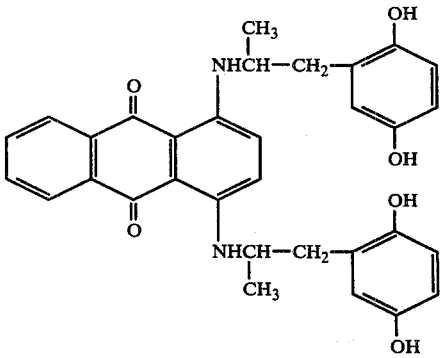

1,4-bis[β-(2′5′-Dihydroxyphenyl)-isopropylamino]-anthroquinone

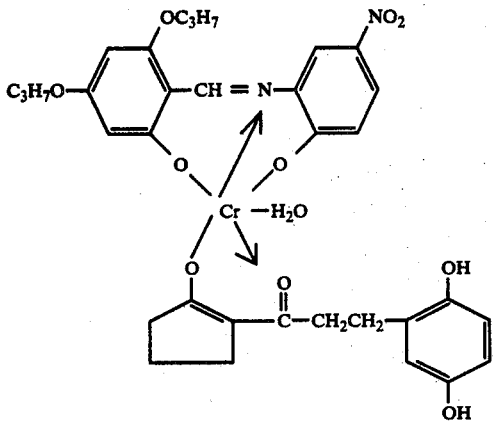
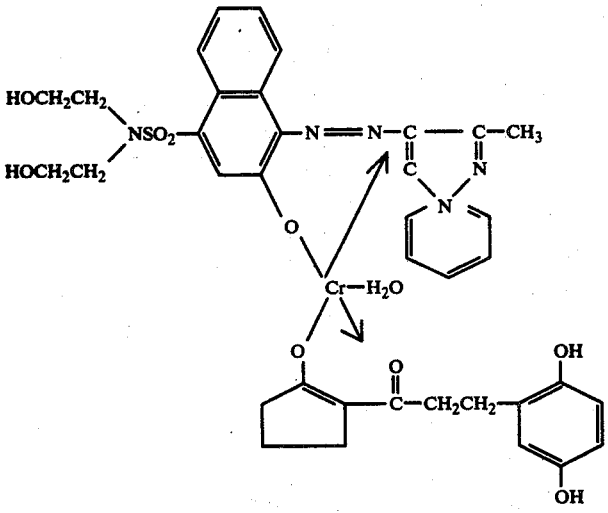
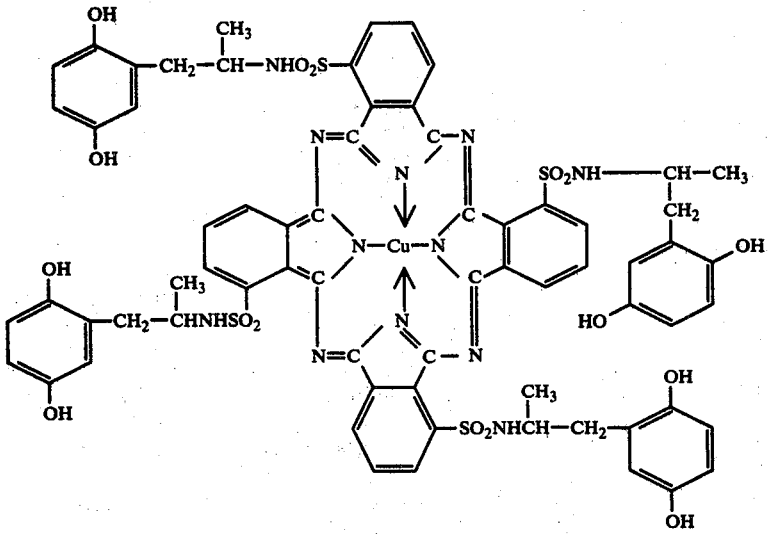
1-Acetoxy-2-{p-[β-hydroquinonyl)ethyl]-phenylazo}-4-methoxy-naphthalene
1-Acetoxy-2-{p-[β-(hydroquinonyl)ethyl]-phenylazo}-4-[(2′-ethoxy)ethoxy]-naphthalene
1-Acetoxy-2-{p-[β-(hydroquinonyl)ethyl]-phenylazo}-4-isopropoxynaphthalene

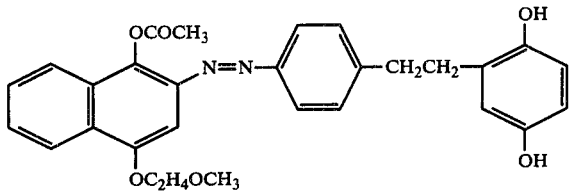

1-Acetoxy-2-{p-[β-(hydroquinonyl)ethyl]-phenylazo}-4-(1',4'-dioxapentyl)naphthalene α-[p-(2-Hydroquinonylethyl)phenylazo]-β-(2'-furyl)-β-acetoxy-acrylonitrile α-[p-(2-Hydroquinonylethyl)phenylazo]-β-(2'-benzofuranyl)-β-acetoxy-acrylonitrile α-[m-(2-Hydroquinonylethyl)phenylazo]-β-(2'-benzofuranyl)β-acetoxy-acrylonitrile α-[m-(Hydroquinonylmethyl)phenylazo]-β-(2'-benzofuranyl)-β-acetoxy-acrylonitrile α-[p-(2-Hydroquinonylethyl)phenylazo]-β-[2'-(5'-bromofuryl)]-β-acetoxy-acrylonitrile α-[p-(2-Hydroquinonylethyl)phenylazo]-β-[2'-(5'-methoxybenzofuranyl)]-β-acetoxy-acrylonitrile α-[p-(2-Hydroquinonylethyl)phenylazo]-β-[2'-(5'-bromobenzofuranyl)]-β-acetoxy-acrylonitrile α-[p-(2-Hydroquinonylethyl)phenylazo]-β-[2'-(3'-methylbenzofuranyl)]-β-acetoxy-acrylonitrile α-Phenylazo-β-[2-(4'-hydroquinonylacetoamidobenzofuranyl)]-β-acetoxy-acrylonitrile α-[p-(2-Hydroquinonylethyl)phenylazo]-β-(2'-benzofuranyl)-β-methoxyacetoxy-acrylonitrile

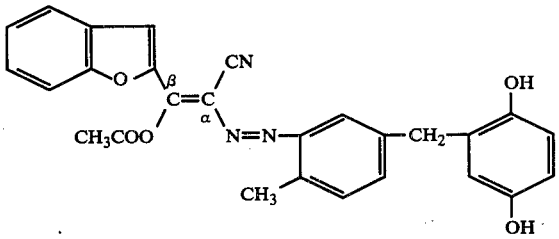

α-[(2-Methyl-5-hydroquinonylmethyl)phenylazo]-β-(2'-benzofuranyl)-β-acetoxy-acrylonitrile α-[(2-Acetoxy-5-hydroquinonylmethyl)phenylazo]-β-(2'-furyl)-β-acetoxy-acrylonitrile α-}[2-Acetoxy-5-(2'-hydroquinonylethyl)]-phenylazo}-β-(2'-benzofuranyl)-β-acetoxy-acrylonitrile α-[(2-Acetoxy-5-hydroquinonylmethyl)phenylazo]-β-[2'-(5'-bromofuryl)]β-acetoxy-acrylonitrile α[(2-Acetoxy-5-hydroquinonylmethyl)phenylazo]-β-[2'-(5'-methoxybenzofuranyl)]-β-acetoxy-acrylonitrile α-[(2-Acetoxy-5-hydroquinonylmethyl)phenylazo]-β-[2'-(5'-bromobenzofuranyl)]-β-acetoxy-acrylonitrile α-[(2-Acetoxy-5-hydroquinonylmethyl)phenylazo]-β-[2'-(3'-methylbenzofuranyl)]-β-acetoxy-acrylonitrile α-(2-Acetoxyphenylazo)-β-[2'-(5'-hydroquinonyl-acetoamido-benzofuranyl)]-β-acetoxy-acrylonitrile

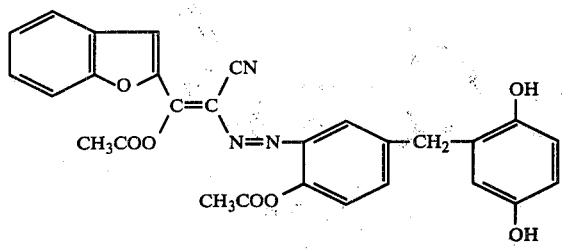

α-[(2-Acetoxy-5-hydroquinonylmethyl)phenylazo]-β-(2'-benzofuranyl)-β-acetoxy-acrylonitrile 2-[m-(Hydroquinonylmethyl)phenylazo]-3-butyroyloxy-5-methyl-benzothiophene 2-[2'-Chloro-5-hydroquinonylmethyl)phenylazo]-3-acetoxy-benzothiophene 2-[p-(2'-Hydroquinonylethyl)phenylazo]-3-acetoxy-benzothiophene 2-[p-(2'-Hydroquinonylethyl)phenylazo]-3-acetoxy-5-chlorobenzothiophene 2-[(2'-Acetoxy-5'-hydroquinonylmethyl)phenylazo]-3-acetoxy-benzothiophene 2-[(2'-Methyl-5'-hydroquinonylmethyl)phenylazo]-3-acetoxy-benzothiophene

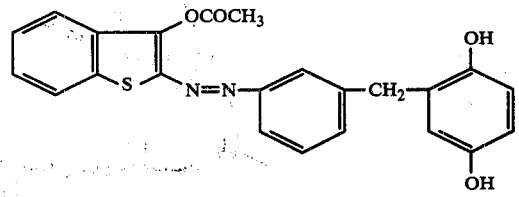

2-[m-(Hydroquinonylmethyl)phenylazo]-3-acetoxybenzothiophene 1,4-bis(2',5'-Dihydroxyaniline)-9,10-dihydroxyanthracene 1,5-bis(2',5'-Dihydroxyaniline)-4,8,9,10-tetrahydroxyanthracene 1,4-bis[β-(2',5'-Dihydroxyphenyl)isopropylamino]-9,10-dihydroxyanthracene 1,4-bis[β-(2',5'-Dihydroxyphenyl)ethylamino]-9,10-dihydroxyanthracene 1-Chloro-4-[β-(2',5'-dihydroxyphenyl)ethylamino]-9,10-dihydroxyanthracene 1,4-bis[γ-(2',5'-Dihydroxyphenyl)propylamino]-5,8,9,10-tetrahydroxyanthracene 1-[γ-(2',5'-Dihydroxyphenyl)propylamino]-4-(β-hydroxyethylamino)-5,8,9,10-tetrahydroxyanthracene 1-[(β-Hydroquinonyl-α-methyl)ethylamino]-4(β-hydroxyethylamino]-5,8,9,10-tetrahydroxyanthracene 1-[β-(2',5'-Dihydroxyphenyl)ethylamino]-5-(β-hydroxyethylamino)-4,8,9,10-tetrahydroxyanthracene 1,5-bis[(β-Hydroquinonyl-α-methyl(ethylamino]-4,8,9,10-tetrahydroxyanthracene 1-[β-(2',5'-Dihydroxyphenyl)ethylamino]-4-hexylamino-5,8,9,10-tetrahydroxyanthracene 1,4-bis[(β-Hydroquinonyl-α-ethyl)ethylamino]-5,8,9,10-tetrahydroxyanthracene 1,4-bis[(β-Hydroquinonyl-α-methyl)ethylamino]-5,8,9,10-tetrahydroxyanthracene 1,4-bis[(β-Hydroquinonyl-α-ethyl)ethylamino]-9,10-dihydroxyanthracene 1,4-bis[(β-Hydroquinonyl-α-methyl)ethylamino]-5,9,10-trihydroxyanthracene 1-(β-Hydroxy-α-ethyl-ethylamino)4-(β-hydroquinonyl-α-methyl-ethylamino)-9,10-dihydroxyanthracene 1-(Butanol-2'-amino)-4-(β-hydroquinonyl-isopropylamino)5,8,9,10-tetrahydroxyanthracene 1,8-bis[β-Hydroquinonyl-α-methyl)ethylamino]-4,5,9,10-tetrahydroxyanthracene N-Monobenzol-1,4-bis[β-(3',4'-dihydroxyphenyl)-ethylamino]-9,10-dihydroxyanthracene N-Monobenzol-1,4-bis[β-(2',5'-dihydroxyphenyl)ethylamino]-9,10-dihydroxyanthracene 1,4-Diamino-2-[(ε-(α-methyl-2',5'-dihydroxyhydrocinnamido)-pentoxy]9,10-dihydroxyanthracene 1,4-Diamino-2-[ε-ethyl-2',5'-dihydroxyhydrocinnamido)-pentoxy]-9,10-dihydroxyanthracene 1,4-Diamino-2-[ε-(2',5'-dihydroxyhydrocinnamido)-pentoxy]-9,10-dihydroxyanthracene

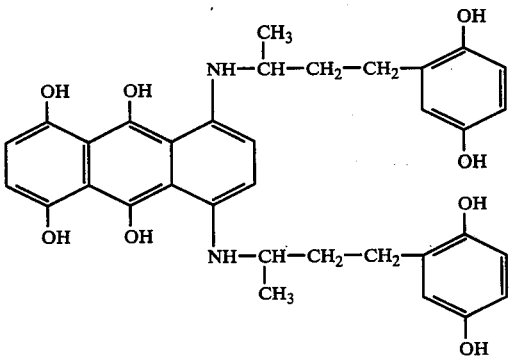

1,4-bis[(γ-Hydroquinonyl-α-methyl)propylamino]-5,8,9,10-tetrahydroxyanthracene 1-(o-Carboxyphenyl)-3-phenyl-4-[p-(2',5'-trifluoroacetoxy-β-phenylethyl)phenylazo]-5-hydroxypyrazole lactone

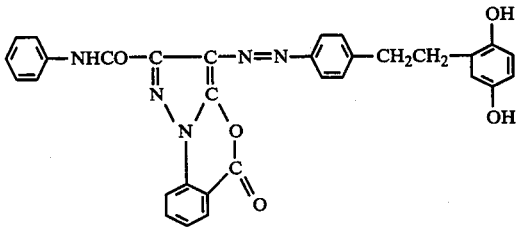

1-(o-Carboxyphenyl)-3-N-phenylcarbamoyl-4-[p-(β-hydroquinonylethyl)phenylazo]-5-hydroxypyrazole lactone α-{[2-Butyroyloxy-5-(2',5'-butyroyloxy-phenylmethyl)]-phenylazo}-β-(2''-benzofuranyl)-β-butyroyloxyacrylonitrile 2-[m-(2'',5''-Butyroyloxy-phenylmethyl)phenylazo]-3-butyroyloxybenzothiophene α-[p-(2,5-Butyroyloxy-β-phenylethyl)phenylazo]-β-(2'-benzofuranyl)-β-butyroyoxy-acetonitrile

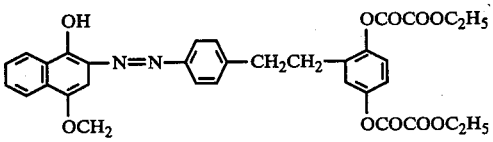

2-[p-(2',5'-Ethoxyoxaloxyphenethyl)phenylazo]-4-methoxy-1-naphthol

In diffusion transfer color photography in which dye developers are used as the dye image-forming materials, for development to proceed quickly, auxiliary silver halide developers are advantageously used. For this purpose, a developer such as 1-phenyl-3-pyrazolidone as described in the specification of U.S. Pat. No. 3,039,869, a hydroquinone derivative such as 4'-methylphenylhydroquinine and t-butylhydroquinone, or a catechol derivative as described in the specification of U.S. Pat. No. 3,617,277 can be added to a liquid processing composition or can be incorporated in the photosensitive element, in particular, in a silver halide emulsion layer, a layer containing the dye developer, an intermediate layer, or the uppermost protective layer of the photosensitive element. Furthermore, for promoting the development and the diffusion transfer, an onium compound such as N-benzyl-α-picolinium bromide as described in the specification of U.S. Pat. No. 3,173,786 can be present.

(b) Diffusible Dye Releasing Couplers

A diffusible dye releasing coupler is a reactive non-diffusible compound which couples with an oxidized developing agent, the compound being able to release a dye which is soluble and diffusible in the liquid processing composition as the result of the coupling reaction.

A diffusible dye releasing coupler of a first type contains a structural moiety which has been substituted by a residue capable of being released by the oxidized developing agent. The electron conjugated system of the dye released can have been preliminary incorporated in the coupler or can be formed by the coupling reaction. The former type is called "pre-formed type" and the coupler exhibits a spectral absorption similar to that of the dye released. On the other hand, the latter type is called "instantly formed type" and the coupler is substantially colorless and if the coupler is colored, the color has no direct relation to the absorption of the dye released and is temporary.

Typical diffusible dye releasing couplers can be represented by the following general formulae:

(1) (Cp-1)—L—(Fr) (pre-formed type) and (2) (Cp-2)—L—(B1) (instantly formed type)

wherein Cp-1 represents the structural moiety reactive to coupling, in which the coupling position is substituted with the (Fr)-L-residue and at least one of the non-coupling positions is substituted with a group having a hydrophobic group of more than about 8 carbon atoms and capable of rendering the coupler molecule diffusion resistant;

Cp-2 designates the structural moiety reactive to coupling in which the coupling position is substituted with the (B1)-L-residue and when the coupler is used together with a developing agent without a water-solubilizing group, the Cp-2 group has at least one water-solubilizing group at a non-coupling position;

The (Fr)-L-group and (B1)-L-group designate a group which can be released by the oxidized developing agent;

Fr designates the dye structural moiety having an absorption in a visible wave length region and at least one water-solubilizing group; and B1 designates a group having a hydrophobic group of more than about 8 carbon atoms and capable of rendering the coupler molecule diffusion resistant.

As the structural moiety reactive to coupling utilized for Cp-1 and Cp-2, many functional groups are known to oxidatively couple with an aromatic primary amino color developing agent. For instance, phenols, anilines, cyclic or open chain active methylene compounds, and hydrazones are examples. Specific examples of particularly useful reactive structural moieties are the residues derived from phenols substituted with an acylamino group, 1-hydroxy-2-napththamides, N,N-dialkylanilines 1-aryl-5-pyrazolones of which the 3-position is substituted with an alkyl group, an aryl group, an alkoxy group, an aryloxy group, an amino group, an acylamino group, a ureido group, or a sulfonamido group, pyrazoloneimidazoles, pyrazolonetriazoles, α-cyanoacetophenones, and α-acylacetoanilides.

Examples of the bonding group L of which the bond to the coupler structure moiety is cleaved by the oxidized developing agent are an azo group, an azoxy group, a mercuryl group (—Hg—), an oxy group, a thio group, a dithio group, a triazolyl group, a diacylamino group, an acylsulfonamino group

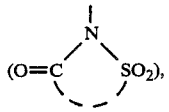

an acyloxy group, a sulfonyloxy group, and an alkylidene group. Of these groups, an oxy group, a thio group, a dithio group, a diacylamino group, and an acyloxy group also are released as an anion are useful because a large amount of diffusible dye is produced. It is preferred that the coupling position of the coupling structure moiety of the phenol or naphthol be substituted with a group connected to an oxy group, thio group, or diacyloxy group and alspo it is preferred that the coupling position of the pyrazolone be substituted with a thio group, azo group, or acyloxy group and the coupling position of acylacetanilide be substituted with an oxy group, thio group, or diacylamino group.

Typical examples of dye structure moieties Fr are residues derived from azo dyes, azomethine dyes, indoaniline dyes, indophenol dyes, anthraquinone dyes, nitro dyes, azine dyes, etc.

The hydrophobic group contained in the residue represented by Cp-1 or B1 contributes to provide a cohesive force to the coupler molecules in an aqueous medium and to render the coupler molecule non-diffusible in a hydrophilic colloid of the photosensitive material. Suitable hydrophobic residues are a substituted or unsubstituted alkyl group having more than about 8 carbon atoms, an alkenyl group, an aralkyl group, an alkylaryl group, etc. For example, a lauryl group, a stearyl group, an oleyl group, a 3-n-pentadecylphenyl group, a 2,4-di-t-amylphenoxy group, etc. can be used. The hydrophobic residue can be bonded to the coupling fundamental structural moiety directly or through a divalent bond such as an amido bond, a ureido bond, an ether bond, an ester bond, and a sulfonamido bond to form Cp-1. Also, the hydrophobic residue can form B1 by itself or by bonding to a residue such as an aryl group or a heterocyclic group directly or through the aforesaid divalent bond.

The water solubilizing group contained in the residue represented by Cp-2 or Fr is an acid group which is substantially dissociated in a liquid processing composition or a preccusor thereof which provides the acid group by hydrolysis. An acid group having a pKa of lower than about 11 is particularly useful. Specific examples of such an acid group are a sulfo group, a sulfuric acid ester group (—O-$SO_3H$), a carboxyl group, a sulfonamido group, a diacylamino group, and a phenolic hydroxyl group.

When the diffusible dye releasing coupler of the type represented by general formula (1) reacts with the oxidized developing agent, bond L is cleaved to form a non-diffusible condensate of Cp-1 and the developing agent and also a soluble dye containing the Fr structure moiety. The soluble dye is transferred by diffusion to the image-receiving layer to form a dye image there.

When the diffusible dye releasing coupler of the type represented by general formula (2) reacts with the oxidized developing agent, bond L is cleaved to form a soluble dye which is the oxidative coupling product of Cp-2 and the developing agent and a non-diffusible released product derived from $B_1$-L-. The soluble dye is transferred to the image-receiving layer by diffusion.

Specific examples of diffusible dye releasing couplers of the type represented by general formula (1 ) are as follows.

α-[4-(8-Acetamido-3,6-disulfo-1-hydroxy-2-naphthylazo)-phenoxy]-α-pivalyl-4-(N-methyl-N-octadecylsulfamyl)acetanilide di-sodium salt 1-(p-t-Butylphenoxyphenyl)-3-[α-(4-t-butylphenoxy)-propionamido]-4-(2-bromo-4-methylamino-5-sulfo-1-anthra-9,10-quinalyl-azo)-5-pyrazolone.

1-Hydroxy-4-{3-[4-N-ethyl:N-β-sulfoethylamino)-2-methylphenylazo]phenylazo}-N-[8-(2,4-di-t-amylphenoxy)butyl]-2-naphthamide sodium salt Specific examples of diffusible dye releasing couplers of the type represented by general formula (2) are as follows.

α-(4-Methoxybenzoyl)-α-(3-octadecylcarbamylphenylthio)-3,5-dicarboxyacetanilide

1-Phenyl-3-(3,5-dicarboxyanilino)-4-(3-octadecylcarbamylphenylthio)-5-pyrazolone 1-Phenyl-3-(3,5-disulfobenzylamino)-5-(2-hydroxy-4-n-pentadecylphenylazo)-5-pyrazolone 1-[4-(3,5-Dicarboxybenzamido)phenyl]-3-ethoxy-4-(3-octadecylcarbamylthio)-5-pyrazolone 1-Hydroxy-4-(3-octadecylcarbamylphenylthio)-N-ethyl-3′,5′-dicarboxy-2-naphthanilide 1-Hydroxy-4-(n-octadecylsuccinimido)-N-ethyl-3′,5′-dicarboxy-2-naphthanilide.

Other examples of the diffusible dye releasing couplers and methods of their production are described in the specifications of British Patents Nos. 840,731; 904,364; and 1,085,631 and the specifications of U.S. Pat. Nos. 3,476,563; 3,644,498; and 3,419,391.

In the diffusible dye releasing coupler of the second type, the dye residue contained in the substituent is split off and released with an intramolecular ring-closure reaction with the substituent at the position adjacent the point of reaction occuring subsequently to the condensation reaction with the oxidized developing agent. In a particularly useful reaction, after oxidative coupling of an aromatic primary amino developing agent to the 4-position of a phenol or aniline, the developing agent forms an azine ring with a sulfonamido group containing a dye structure portion at the 3-position of the phenol or aniline to release a diffusible dye containing a sulfonic acid group. Specific examples of compounds of this type are as follows.

1-Phenyl-3-ethylcarbamoyl-4-{2-methoxy-4-[N-n-dodecyl-N-(1-hydroxy-4-chloro-3-naphthyl)]sulfamylphenylazo}-5-pyrazolone,
2-(β-Octadecylcarbamoylethyl)-4-{2-[4-(2-hydroxy-1-naphthylazo)phenylsulfonamido]-anilino}phenol, etc.

Suitable aromatic primary amino developing agents which can be used with the diffusible dye releasing type coupler are p-aminophenol, p-phenylenediamines, and derivatives of them. Particularly useful examples of these compounds are 2-chloro-4-aminophenol, 2,6-dibromo-4-aminophenol, 4-amino-N,N-diethyl-3-methylaniline, N,N-diethyl-p-phenylenediamine, N-ethyl-β-methanesulfonamidoethyl-3-methyl-4-aminoanilline, 4-amino-N-ethyl-N-(ε-sulfobutyl)-aniline, 4-amino-N-ethyl-N-(β-hydroxyethyl)-aniline, 4-amino-3-methyl-N-ethyl-N-(β-hydroxyethyl)aniline, 4-amino-N-ethyl-N-(β-carboxyethyl)aniline, 4-amino-N,N-bis(β-hydroxyethyl)-3-methyl-aniline, 3-acetamido-4-amino-N,N-(β-hydroxyethyl)aniline, 4-amino-N-ethyl-N-(2,3-dihydroxypropyl)-3-methylaniline, 4amino-N,N-diethyl-3-(3-hydroxypropoxy)aniline, 4-amino-N-ethyl-N-(β-hydroxyethyl)-3-methoxyaniline, and the hydrochlorides, sulfates, oxalates, and p-tolenesulfonates of these anilines. Furthermore, the Schiff bases of these anilines and precursors of the developing agent such as phthalimides are useful because they can be incorporated in the photosensitive elements.

The negative silver halide emulsion layer containing the diffusible dye releasing coupler provides a negative diffusion transfer color image on development.

Useful examples of direct positive type silver halide emulsion are the fogged type silver halide emulsions as described in the specifications of British Patente Nos. 444,245 and 462,730 and the specifications of U.S. Pat. Nos. 2,005,837; 2,541,472; and 3,367,778 and the internal latent image type silver halide emulsions as described in the specifications of U.S. Pat. Nos. 2,592,250; 2,588,982; and 3,227,552.

By treating the layer containing the diffusible dye releasing coupler and physical development nuclei disposed adjacent the negative type silver halide emulsion layer with a developer containing a silver halide solvent, a positive diffusion transfer color image is obtained. As a reversal dye image forming technique wherein physical development is utilized, the technique described in the specification of British Pat. No. 904,364 can be utilized. Furthermore, a photosensitive element having a layer containing a diffusible dye releasing coupler and a metal salt which can be spontaneously reduced adjacent a negative type silver halide emulsion layer containing a so-called DIR compound, i.e., a compound which releases a development inhibitor such as 1-phenyl-5-mercaptotetrazole on reaction with the oxidation product of the developing agent provides a positive diffusion transfer color image as disclosed in the specification of U.S. Pat. Nos. 3,227,551; 3,227,554; and 3,364,022 and the specification of German OLS No. 2,032,711. In the present invention, a combination of these silver halide emulsions and the dye image-forming materials can be used and the system of providing a negative dye image or a positive dye image can be selected depending on the purpose.

(c) Diffusible Dye Releasing Reducing Agents

In the present invention, in addition to the aforesaid dye developers and the diffusible dye releasing couplers, a reducing agent oxidized as a result of the development, in which the reducing agent releases a diffusible dye by an intramolecular reaction or a reaction with an auxiliary agent in a solution can be used as the dye image-forming material. For dye image formation of this type, it is advantageous to oxidize the dye image-forming material using an auxiliary developing agent such as a hydroquinone and a 3-pyrazolidone. The oxidized dye image-forming material releases a diffusible dye due to the action of an auxiliary agent, such as hydroxyl ion or sulfite ion present in the liquid processing composition or the photosensitive element. Specific examples of dye image-forming materials of the type are disclosed in the specifications of U.S. Pat. Nos. 3,585,026 and 3,698,897 and the specification of German OLS No. 2,242,762.

The dye image-forming materials used in this invention can be dispersed in a hydrophilic colloid using various techniques depending on the type of dye image-forming material. For instance, a diffusible dye releasing coupler having a dissociable group such as a sulfo group or a carboxyl group can be dissolved in water or an alkaline aqueous solution and then the solution is added to an aqueous solution of a hydrophilic colloid. A dye image-forming material which is sparingly soluble in aqueous medium but readily soluble in organic solvents can be dissolved in an organic solvent and then the organic solvent solution is added to an aqueous solution of a hydrophilic colloid followed by stirring to form a dispersion of fine particles. Examples of the suitable organic solvents solvent which can be used in such a case are ethyl acetate, tetrahydrofuran, methyl ethyl ketone, cyclohexanone, β-butoxy-β-ethoxyethyl acetate, dimethylformamide, dimethyl sulfoxide, 2-methoxyethanol, tri-n-butyl phthalate, etc. Of these dispersion solvents, a solvent having a comparatively low vapor pressure can be evaporated on drying of the photographic layers or evaporated before coating as described in the specifications of U.S. Pat. Nos. 2,322,027 and 2,801,171. Also, of these solvents, a solvent which is soluble in water can be removed using the water washing method as described in the specifications of U.S. Pat. Nos. 2,949,360 and 3,396,027. Furthermore, for stabilizing the dispersion of the dye image-forming material and promoting the formation of dye images, it is advantageous to incorporate in the photosensitive element a solvent substantially insoluble in water and having a boiling point of higher than about 200° C. at normal pressure together with the dye image-forming material. Examples of high boiling solvents suitable for this purpose are aliphatic esters such as the triglyceride of a higher fatty acid and di-octyl adipate; a phthalic acid ester such as di-n-butyl phthalate; a phosphoric acid ester such as tri-o-cresyl phosphate and tri-n-hexyl phosphate; an amide such as N,N-dimethyllaurylamide; and a hydroxy compound such as 2,4-di-n-amylphenol. Still further, for stabilizing the dispersion of the dye image-forming material and promoting formation of dye images it is also advantageous to incorporate a polymer having an affinity to the solvent in the photosensitive element together with the dye image-forming material. Examples of polymers suitable for this purpose are shellac, a phenol-formaldehyde consensate, poly-n-butyl acrylate, a copolymer of n-butyl acrylate and acrylic acid, and a copolymer of n-butyl acrylate, styrene and methacrylamide. The polymer can be dispersed in a hydrophilic colloid as a solution thereof and the dye image-forming material in an organic solvent or a hydrosol of the polymer prepared using emulsion polymerization, etc., can be added to a hydrophilic colloid dispersion of the dye image-forming material.

The dispersion of the dye image-forming material can be effectively attained using a large shearing force. The dispersion of the dye image-forming material is very effectively assisted using a surface active agent as an emulsifier. Useful means for applying the shearing force to the dispersion of the dye image-forming material is, for example, a high speed rotary mixer, a colloid mill, a high pressure milk homogenizer, the high pressure homogenizer as disclosed in the specification of British Patent No. 1,304,206, and a supersonic emulsififying means. Also, examples of the surface active agent which can be used for the dispersion of the dye image-forming material are sodium triisopropylnaphthalene sulfonate, sodium dinonylnaphthalene sulfonate, sodium p-dedecylbenzene sulfonate, dioctylsulfosuccinate sodium salt, sodium cetylsulfate, and the anionic surface active agents as disclosed in the specification of Japanese Patent Publication No. 4293/64. The use of these anionic surface active agents and a higher fatty acid ester of anhydrohexitol shows a particularly excellent emulsifying effect as disclosed in the specification of U.S. Pat. No. 3,676,141.

The silver halide emulsion used in this invention is a colloidal dispersion of silver chloride, silver bromide, silver chlorobromide, silver iodobromide, silver chloroiodobromide, or a mixture thereof. The halogen composition is selected depending on the purpose of the photographic material and the processing condition but a silver iodobromide emulsion or silver chloroiodobromide emuslion containing about 1 to 10 mole percent of iodide, less than about 30 mole percent of chloride, and the remainder being bromide is particularly desirable. The preferable mean grain size of the silver halide grains ranges from about 0.1 micron to about 2 microns and depending on the purpose, silver halide grains having a uniform grain size are desirable. The form of the silver halide grains can be that of a cubic system, an octahedral system, or a mixed crystal system. These silver halide emulsions can be prepared in a conventional manner, e.g., as described in P. Glafkides; *Chimie Photographique,* 2nd Edition, Chapters 18–23, Paul Montel, Paris (1957). That is, a soluble silver salt such as silver nitrate is reacted with a water-soluble halide such as potassium bromide in an aqueous solution of a protective colloid such as gelatin and the crystals of silver halide are grown in the presence of an excessive amount of a halide or a silver halide solvent such as ammonia. In this case, a crystal precipitation method such as a single jet method, a double jet method, and a pAg control/-double jet method can be used.

The soluble salt is removed from the silver halide emulsiion prepared by water washing or dialysis of the silver halide emulsion coagulated by cooling, the addition of a precipitant such as an anionic polymer having a sulfone group, a sulfuric acid ester group, or a carboxyl group followed by pH adjustment, and the use of an acylated protein such as phthaloyl gelatin as protective colloid followed by pH adjustment.

It is desirable that the silver halide emulsion used in this invention be chemically sensitized using the natural sensitizers contained in gelatin, a sulfur sensitizer such as sodium thiosulfate and N,N'-trimethylthiourea, a gold sensitizer such as a thiocyanate complex salt of monovalent gold and a thiosulfate complex salt of monovalent gold, or a reduction sensitizer such as stannous chloride and hexamethylenetetramine. In the present invention, a silver halide emulsion which can readily form a latent image on the surfaces of the grains or a silver halide emulsion which can readily form a latent image inside of the grains as described in the specifications of U.S. Pat. Nos. 2,592,550 and 3,206,313 can be used.

The silver halide emulsion used in this invention can be stabilized with an additive such as 4-hydroxy-6-methyl-1,3,3a,7-tetraazaindene, 5-nitroimadazole, 1-phenyl-5-mercaptotetrazole, 8-chloromercuryl quinoline, benzenesulfinic acid, and pyrocatechin. Furthermore, an inorganic compound such as cadmium salt, a mercury salt, and a complex salt of a platinum series element, i.e., a chlorocomplex salt of palladium is also useful for the stabilization of the photosensitive materials of this invention. The silver halide emulsion of this invention can further contain a sensitizing compound such as a polyethylene oxide compound.

The silver halide emulsion used in this invention can be provided with, if desired, color sensitivity enhanced by an optical sensitizing dye. Examples of useful optical sensitizers are cyanine dyes, merocyanine dyes, holopolar cyanine dyes, styryl dyes, henicyanine dyes, oxanol dyes, and hemioxanol dyes. Specific examples of optical sensitizers are described in P. Glafkides; *Chimie Photographique,* 2nd Edition, Chapters 35–41, Paul Montel, Paris (1957) and F. M. Hamer, *The Cyanine Dyes and Related Compounds.* In particular, cyanines in which the nitrogen atom of the nucleus is substituted with an aliphatic group containing a hydroxyl group, a carboxyl group, or a sulfo group, for instance, the cyanines as described in the specifications of U.S. Pat. Nos. 2,503,766; 3,459,553; and 3,177,210, are particularly useful for the practice of this invention.

The silver halide emulsion layers, a layer containing the dye image-forming material, subsidiary layers such as a protective layer and an intermediate layer, etc., used in this invention containa hydrophilic polymer as a binder. Specific examples of suitable hydrophilic polymers are gelatin, casein, gelatin modified by an acylating agent, etc., gelatin grafted with a vinyl polymer, proteins such as albumin, cellulose derivatives such as hydroxyethyl cellulose, methyl cellulose, and carboxymethyl cellulose, polyvinyl alcohol, partially hydrolized polyvinyl acetate, polyvinylpyrrolidone, high molecular weight nonelectrolytes such as polyacrylaminde, polyacrylic acid, partially hydrolyzed polyacrylamide, anionic synthetic polymers such as a coolymer of vinyl methyl ether and maleic acid, and amphoteric synthetic polymers such as a copolymer of acrylic acid and acrylamide and polyacrylamide subjected to a Hofmann reaction. These hydrophilic polymers can be used individually or as a mixture thereof. Furthermore, the hydrophilic polymer layer can contain a latex-like polymer dispersion of a hydrophobic monomer such as an alkyl acrylate and an alkyl methacrylate.

These hydrophilic polymers, in particular hydrophilic polymers having a functional group such as an amino group, a hydroxyl group, and a carboxyl group, can be insolubilized by various cross-linking agents without loss of their permeability to the liquid processing composition. Examples of particularly useful cross-linking agents are aldehyde compounds such as formaldehyde, glyoxal, glutaraldehyde, mucochloric acid, and an oligomer of acrolein; the aziridine compounds such as triethylene phosphoramide as described in the specification of Japanese Patent Publication No. 8790/62; the epoxy compounds such as 1,4-bis(2',3'-epoxypropoxy)-diethyl ether as decribed in the specification of Japanese Patent Publication No. 7133/59; the active halogen compounds such as 2-hydroxy-4,6-dichloro-s-triazine sodium salt as described in the specification of U.S. Pat. No. 3,325,287; active oefin compounds such as hexahydro-1,3,5-triacryl-s-triazine; methylol compounds such as N-polymethylol urea and hexamethylol melamine; dialdehyde starch; and the 3-hydroxy-5-chloro-s-triazinilated gelatin as described in the specification of U.S. Pat. No. 3,362,827. Still further, the hydrophilic polymer layer can contain a cross linking reaction promotor such as a carbonate and resorcinol in addition to the above described cross linking agent.

The photographic layers used in this invention can be coated on a support using a dip coating method, a roller coating method, an air knife coating method, the bead coating method as described in the specification of U.S. Pat. No. 2,681,294, and the curtain coating method as described in the specifications of U.S. Pat. Nos. 3,508,947 and 3,513,017. In a multilayer type photosensitive element, it is advantageous to coat simultaneously a plurality of layers using the multi-slit hopper as described in the specifications of U.S. Pat. Nos. 2,761,417; 2,761,418; 2,761,419; and 2,761,791.

To facilitate the coating of the photographic layers used in this invention, it is advantageous to incorporate various surface active agents into the coating compositions as a coating aid. Examples of useful coating aids are nonionic surface active agents such as saponin, an ethylene oxide adducts of p-nonylphenol, a monoalkyl ether of glycerin, etc.; anionic surface active agents such as sodium dodecylsulfate, sodium p-dodecylbenzenesulfonate, sodium diocytlsulfosuccinate, etc.; and amphoteric surface active agents such as carboxymethyldimethyllauryl ammonium hydroxide internal salt, "Deriphat 151" trade name produced by General Mills, and the betaine compounds as described in the specifications of U.S. Pat. No. 3,441,413; British Patent No. 1,159,825; and Japanese Patent Publication No. 21985/71.

Furthermore, to further facilitate the coating procedure of the photographic layers used in this invention, various viscosity increasing agents can be incorporated in the coating compositions. For instance, high molecular weight polyacrylamide which can increase the viscosity of the coating composition by itself; cellulose sulfate; poly-p-sulfostyrene potassium salt; and the acrylic acid polymer as described in the specification of U.S. Pat. No. 3,655,407, which exhibits a viscosity increasing action due to the interaction with a polymer binder in the coating composition can be used.

In the photosensitive element of this invention, the silver halide emulsion has a dye image-forming material associated with the silver halide in the emulsion layer. The combination of the color sensitivity of the silver halide emulsion and the spectral absorption characteristics of the dye image is appropriately selected depending to the desired color reproduction. For reproduction of natural color by the subtractive color process, at least two combinations of silver halide emulsions having selective optical sensitivities in certain wave length regions and compounds forming dye images having selective spectral absorptions in the same wave length regions are used. A particularly useful photosensitive element has a combination of a blue-sensitive silver halide emulsion and a compound forming a yellow dye image, a combination of a green-sensitive silver halide emulsion and a compound forming a magenta dye image, and a combination of a redsensitive silver halide emulsion and a compound forming a cyan dye image. The combination of the silver halide emulsion and the dye image-forming material is obtained by coating both components as layers in the photosensitive element in a face-to-face relationship or by coating a mixture of both components as particles.

In a preferred multilayer structure, a blue-sensitive silver halide emulsion layer, a green-sensitive silver halide emulsion layer and a red-sensitive silver halide emulsion layer are formed on the support in succession from the exposure side and in particular, in using highly sensitive silver halide emulsions containing iodide, a yellow filter layer can be disposed between the blue-sensitive silver halide emulsion and the green-sensitive silver halide emulsion. The yellow filter contains a dispersion of colloidal silver, a dispersion of an oil-soluble yellow dye, an acid dye mordanted to a basic polymer, or a basic dye mordanted to an acid polymer. It is preferred that the silver halide emulsion layers be insulated or separated from each other by an intermediate layer. The intermediate layer prevents undesirable interactions between silver halide emulsion units having different color sensitivity from each other from occurring. The intermediate layer is composed of a hydrophilic polymer such as gelatin, polyacrylamide, or partially hydroylzed polyvinyl acetate, as well as a porous polymer formed by a latex of a hydrophilic polymer and a hydrophobic polymer as described in the specification of U.S. Pat. No. 3,625,685 or a polymer such as calcium alginate, whose hydrophilic property is increased gradually by a liquid processing composition as described in the specification of U.S. Pat. No. 3,384,483. The intermediate layer can contain an inhibitor for the interaction of layers selected depending on the kind of the dye image-forming material and the formulation of the liquid processing composition. For instance, in using a dye image-forming material of the type releasing a diffusible dye due to the oxidation product of a developing agent, a reducing agent such as a non-diffusible hydroquinone derivative and a non-diffusible coupler which can be fixed by reaction with the oxidation product are effective for preventing undesirable exchange of the oxidation product of the developing agent between the silver halide emulsion layer units. Furthermore, in the system wherein image reversal is achieved by physical development, it is preferred that the intermediate layer contains physical development nuclei such as metallic silver colloid in addition to the aforesaid additives. Also, in the system wherein the image reversal is conducted using a development-inhibitor-releasing (DIR) compound, better color reproduction is obtained by incorporation of low sensitive and fine silver halide grains.

The liquid processing composition used in this invention is a liquid composition containing the components necessary for developing the silver halide emulsions and forming the dye images by diffusion transfer. The predominant solvent is water but it can contain a hydrophilic solvent such as methanol and methyl cellosolve. The processing composition has a pH sufficient for development of the silver halide emulsion layers and contains alkali in an amount necessary for neutralizing the acid formed during the steps of development and dye image formation. Examples of alkalis are sodium hydroxide, potassium hydroxide, a dispersion of calcium hydroxide, tetramethyl ammonium hydroxide, sodium carbonate, trisodium phospahte, and diethylamine. The processing composition has, preferably a pH of higher than about 12 at room temperature (about 20°-30° C). More preferably, the processing composition contains a hydrophilic polymer such as high molecular weight polyvinyl alcohol, hydroxyethyl cellulose, or sodium carboxymethyl cellulose. Such a hydrophilic polymer increases the viscosity of the processing composition higher than 1 poise, preferably to about 1000 poises at room temperature and facilitates the uniform spreading of the processing composition at development as well the formation of an integral film when the aqueous medium diffuses into the photosensitive element and the image-receiving element during development and the processing composition is concentrated, which contributes to uniting film unit after processing. The polymer film also contributes to preventing a change in the image by controlling the transfer of coloring components to the image-receiving element after the formation of the dye images by diffusion transfer is substantially completed.

It is, sometimes, preferable that the liquid processing composition further contains a light absorbent such as carbon black for preventing the silver halide emulsion layers from being fogged by ambient light during processing and the desensitizer as described in the specification of U.S. Pat. No. 3,579,333. For instance, in using dye developers, the processing composition contains an auxiliary developing agent such as p-aminophenol, 4'-methylphenyl hydroquinone, and 1-phenyl-3-pyrazolidone; an onium type developing accelerator such as N-benzyl-α-picolinium bromide, and an antifoggant such as benzotriazole and in using diffusible dye releasing couplers, the processing composition contains a developing agent such as an aromatic primary amino color developing agent, an antioxidant such as a sulfite and ascorbic acid, an antifoggant such as a halide and 5-nitrobenzimidazole, and a silver halide solvent such as a thiosulfate and uracil.

Furthermore, when a light reflecting agent such as titanium dioxide is added to the liquid processing composition, the positive image formed can be observed through the support of the imagereceiving element after spreading the processing composition and completion of the diffusion transfer without separating the negative material and the image-receiving element in the case of using a transparent film such as polyethylene terephthalate film or a cellulose triacetate film as the support of the image-receiving element. In this case, the proportion of the light reflecting agent are in the processing compositions is suitably about 20 to 60% although there is no limitation on this proportion.

When such a light reflecting agent is not used, the negative material is separated from the image-receiving material after exposure and diffusion transfer processing, and the positive image formed on the image-receiving element can be observed.

Advantageously the liquid processing composition is retained in a rupturable container. The container can be by folding a sheet of a material which is liquid and air impermeable and sealing both ends thereof. The liquid processing composition is retained in the space formed in the container and the container thus retaining the processing composition is so disposed in the film unit that when the film unit is passed through a pressure applying means, the container is ruptured by the internal pressure applied to the processing composition by the pressure applying means at a pre-determined position and releases the contents. The material forming the container can be a laminate sheet of a polyethylene terphthalate film a polyvinyl alcohol film, and polyethylene film or a laminate sheet of a lead foil and a vinyl chloride-vinyl acetate copolymer film. It is desirable that the container be fixed along the leading edge (in the direction of travel toward the pressure applying means) of the film unit and the processing composition is spread, when the container is ruptured, over the surface of the photosensitive element in substantially one direction. Preferable examples of such a container are described in the specification U.S. Pat. Nos. 2,543,181; 2,643,886; 2,653,732; 2,723,051; 3,056,491; 3,056,492; 3,152,515; and 3,173,580.

Then, the invention is explained in greater detail by reference to the following examples. Unless otherwise indicated, all parts, percents ratios and the like are by weight.

EXAMPLE

The color diffusion transfer Image-Receiving Elements 1 to 21 composed of a single image-receiving layer were prepared using Polymer Mordants I-1 to I-10 and II-1 to II-10 and also poly-4-vinylpyridine as a reference sample, respectively, in the following manner.

Preparation of Image-Receiving Material

A paper support composed of a white paper coated with polyethylene films and having a subbing layer coated thereon was coated with a coating composition prepared by adding 0.1 g of polyoxyethyleneonylphenyl ether to 100 g of an aqueous solution containing 3% by weight of the polymer mordant and 6% by weight of polyvinyl alcohol, Gosenol GH-17 (trade name, made by Nippon Gosei Kagaku Kogyo K.K.) to form an image-receiving layer having a dry thickness of 7 microns. In addition, when poly-4-vinylpyridine was used as the polymer mordant, it was dissolved using 3 ml of glacial acetic acid.

Preparation of Photosensitive Element

A photosensitive element was prepared by coating, in succession, the following layers on a cellulose triacetate support:

(1) Cyan Dye Developer Layer 15 g of 1,4-bis(α-methyl-β-hydroquinonylpropylamino)-5,8-dihydroxyanthraquinone was dissolved in a mixture of 25 ml of N-diethyllaurylamide, 25 ml of methylcyclohexanone, and 1 g of sodium dioctylsulfosuccinate under heating at 70° C. The solution was emulsified and dispersed in 160 ml of an aqueous solution of 10% by weight gelatin containing 10 ml of an aqueous solution of 5% by weight of sodium n-dodecylbenzenesulfonate. Then, water was added to the dispersion to make the total volume 500 ml and the dispersion was coated in a dry thickness of 5 microns.

(2) Red-Sensitive Emulsion Layer

A red-sensitive silver iodobromide emulsion (containing 1 mole percent of silver iodide) containing $5.5 \times 10^{-2}$ mole of silver and 5.0 g of gelatin per 100 g of emulsion was coated in a dry thickness of 3.5 microns.

(3) Intermediate Layer 100 ml of an aqueous solution of 5% by weight of gelatin containing 1.5 ml of an aqueous solution of 5% by weight of sodium n-dodecylbenzenesulfonate was coated thereon in a dry thickness of 1.5 microns.

(4) Magenta Dye Developer Layer 10 g of a magenta dye developer, 4-propoxy-2-[p-(β-hydroxyquinonylethyl)phenylazo]-1-naphthol was dissolved in a mixture of 20 ml of N-n-butylacetanilide and 25 ml of methylcyclohexanone under heating and the solution was emulsified and dispersed in 120 ml of an aqueous solution of 10% by weight of gelatin containing 8 ml of an aqueous solution of 5% by weight of sodium n-dodecylbenzenesulfonate and after adding water thereto to make the total volume 400 ml, the dispersion was coated in a dry thickness of 3.5 microns.

(5) Green-Sensitive Emulsion Layer

A green-sensitive silver iodobromide emulsion (containing 2 mole percent of silver iodide) containing $4.7 \times 10^{-2}$ mole of silver and 6.2 g of gelatin per 100 g of emulsion was coated in a dry thickness of 1.8 microns.

(6) Intermediate Layer 100 ml of an aqueous solution of 5% by weight of gelatin containing 1.5 ml of an aqueous solution of 5% by weight of sodium n-dodecylbenzenesulfonate was coated in a dry thickness of 1.0 micron.

(7) Yellow Dye Developer Layer 10 g of a yellow dye developer, 1-phenyl-3-N-n-hexylcarboxyamido-4-[p-2',5'-dihydroxyphenethyl)-phenylazo]-5-pyrazolone was dissolved in a mixture of 10 ml of N-n-butylacetanilide and 25 ml of cyclohexanone. The solution was emulsified and dispersed in 100 ml of an aqueous solution of 10% by weight of gelatin containing 8 ml of an aqueous solution of 5% by weight of sodium n-dodecylbenzenesulfonate. After adding further to the dispersion 5 ml of an aqueous solution of 2% by weight of 2-hydroxy-4,6-dichloro-s-triazine and also water to make the total volume 300 ml, the dispersion was coated in a dry thickness of 1.5 microns.

(8) Blue-Sensitive Emulsion Layer

A blue-sensitive silver iodobromide emulsion (containing 7 mole percent of silver iodide) containing $3.5 \times 10^{-2}$ mole of silver and 6.5 g of gelatin per 100 g of emulsion was coated in a dry thickness of 1.5 microns.

(9) Protective Layer

An aqueous solution of 4% by weight of gelatin containing 2 ml of an aqueous solution of 5% by weight of sodium n-dodecylbenzenesulfonate and 5 ml of an aqueous solution of 2% by weight mucochloric acid was coated in a dry thickness of 1 micron.

The evaluation was cnducted as follows: The photosensitive elements thus prepared were subjected to three kinds of exposure; that is, (1) exposed to blue light and green light only, (2) exposed to red light and blue light only, and (3) exposed to red light and green light only.

The development processing was conducted by spreading a processing solution having the following formulation between the photosensitive element and the image-receiving element at a coverage of 1.8 ml/100 $cm^2$, carrying out the diffusion transfer for 60 seconds, and separating the image-receiving element.

| Processing Composition: | | |
|---|---|---|
| Water | 100 | ml |
| Potassium Hydroxide | 11.2 | g |
| Hydroxyethyl Cellulose (Natrosol 250 HR, made by Hercules Inc.) | 3.4 | g |
| Benzotriazole | 3.5 | g |
| N-Benzyl-α-picolinium Bromide | 2.0 | g |
| Zinc Nitrate | 0.5 | g |
| Potassium Thiosulfate | 0.5 | g |

-continued

| Processing Composition: | | |
|---|---|---|
| Lithium Nitrate | 0.5 | g |

After completing the diffusion transfer process, the integral density in each domain was measured by reflectance using a red filter, a green filter, and a blue filter. The results obtained are shown in the following tables.

| Image-Receiving Element 1 | Density | | |
|---|---|---|---|
| Exposure | Red Filter | Green Filter | Blue Filter |
| Blue and Green | 1.31 | 0.49 | 0.40 |
| Red and Blue | 0.07 | 0.96 | 0.54 |
| Red and Green | 0.08 | 0.15 | 1.00 |

| Image-Receiving Element 2 | Density | | |
|---|---|---|---|
| Exposure | Red Filter | Green Filter | Blue Filter |
| Blue and Green | 1.28 | 0.58 | 0.41 |
| Red and Blue | 0.08 | 0.97 | 0.53 |
| Red and Green | 0.10 | 0.14 | 1.10 |

| Image-Receiving Element 3 | Density | | |
|---|---|---|---|
| Exposure | Red Filter | Green Filter | Blue Filter |
| Blue and Green | 1.37 | 0.58 | 0.40 |
| Red and Blue | 0.08 | 1.04 | 0.56 |
| Red and Green | 0.07 | 0.19 | 1.09 |

| Image-Receiving Element 4 | Density | | |
|---|---|---|---|
| Exposure | Red Filter | Green Filter | Blue Filter |
| Blue and Green | 1.37 | 0.65 | 0.46 |
| Red and Blue | 0.05 | 0.99 | 0.61 |
| Red and Green | 0.09 | 0.15 | 1.22 |

| Image-Receiving Element 5 | Density | | |
|---|---|---|---|
| Exposure | Red Filter | Green Filter | Blue Filter |
| Blue and Green | 1.32 | 0.54 | 0.39 |
| Red and Blue | 0.06 | 0.93 | 0.56 |
| Red and Green | 0.06 | 0.14 | 1.02 |

| Image-Receiving Element 6 | Density | | |
|---|---|---|---|
| Exposure | Red Filter | Green Filter | Blue Filter |
| Red and Green | 1.32 | 0.54 | 0.39 |
| Red and Blue | 0.06 | 0.93 | 0.56 |
| Red and Green | 0.06 | 0.14 | 1.02 |

| Image-Receiving Element 7 | Density | | |
|---|---|---|---|
| Exposure | Red Filter | Green Filter | Blue Filter |
| Blue and Green | 1.34 | 0.59 | 0.38 |
| Red and Blue | 0.08 | 0.99 | 0.57 |
| Red and Green | 0.09 | 0.18 | 1.13 |

| Image-Receiving Element 8 | Density | | |
|---|---|---|---|
| Exposure | Red Filter | Green Filter | Blue Filter |
| Blue and Green | 1.36 | 0.55 | 0.42 |
| Red and Blue | 0.09 | 0.97 | 0.58 |
| Red and Green | 0.06 | 0.16 | 1.06 |

| Image-Receiving Element 9 | Density | | |
|---|---|---|---|
| Exposure | Red Filter | Green Filter | Blue Filter |
| Blue and Green | 1.28 | 0.49 | 0.37 |
| Red and Blue | 0.08 | 0.91 | 0.59 |
| Red and Green | 0.09 | 0.13 | 1.00 |

| Image-Receiving Element 10 | Density | | |
|---|---|---|---|
| Exposure | Red Filter | Green Filter | Blue Filter |
| Blue and Green | 1.36 | 0.62 | 0.42 |
| Red and Blue | 0.07 | 0.96 | 0.58 |
| Red and Green | 0.11 | 0.13 | 1.14 |

-continued

| Image-Receiving Element 11 | | | |
|---|---|---|---|
| | Density | | |
| Exposure | Red Filter | Green Filter | Blue Filter |
| Blue and Green | 1.50 | 0.72 | 0.52 |
| Red and Blue | 0.09 | 1.08 | 0.68 |
| Red and Green | 0.13 | 0.15 | 1.32 |

| Image-Receiving Element 12 | | | |
|---|---|---|---|
| | Density | | |
| Exposure | Red Filter | Green Filter | Blue Filter |
| Blue and Green | 1.53 | 0.70 | 0.54 |
| Red and Blue | 0.07 | 1.04 | 0.72 |
| Red and Green | 0.11 | 0.16 | 1.52 |

| Image-Receiving Element 13 | | | |
|---|---|---|---|
| | Density | | |
| Exposure | Red Filter | Green Filter | Blue Filter |
| Blue and Green | 1.48 | 0.70 | 0.54 |
| Red and Blue | 0.06 | 1.02 | 0.70 |
| Red and Green | 0.12 | 0.17 | 1.42 |

| Image-Receiving Element 14 | | | |
|---|---|---|---|
| | Density | | |
| Exposure | Red Filter | Green Filter | Blue Filter |
| Blue and Green | 1.45 | 0.68 | 0.50 |
| Red and Blue | 0.09 | 1.07 | 0.76 |
| Red and Green | 0.10 | 0.18 | 1.48 |

| Image-Receiving Element 15 | | | |
|---|---|---|---|
| | Density | | |
| Exposure | Red Filter | Green Filter | Blue Filter |
| Blue and Green | 1.60 | 0.78 | 0.58 |
| Red and Blue | 0.12 | 1.18 | 0.73 |
| Red and Green | 0.16 | 0.19 | 1.46 |

| Image-Receiving Element 16 | | | |
|---|---|---|---|
| | Density | | |
| Exposure | Red Filter | Green Filter | Blue Filter |
| Blue and Green | 1.56 | 0.79 | 0.55 |
| Red and Blue | 0.09 | 1.06 | 0.74 |
| Red and Green | 0.12 | 0.18 | 1.62 |

| Image-Receiving Element 17 | | | |
|---|---|---|---|
| | Density | | |
| Exposure | Red Filter | Green Filter | Blue Filter |
| Blue and Green | 1.45 | 0.67 | 0.51 |
| Red and Blue | 0.06 | 1.01 | 0.69 |
| Red and Green | 0.10 | 0.18 | 1.52 |

| Image-Receiving Element 18 | | | |
|---|---|---|---|
| | Density | | |
| Exposure | Red Filter | Green Filter | Blue Filter |
| Blue and Green | 1.59 | 0.79 | 0.57 |
| Red and Blue | 0.08 | 1.14 | 0.78 |
| Red and Green | 0.08 | 0.18 | 1.42 |

| Image-Receiving Element 19 | | | |
|---|---|---|---|
| | Density | | |
| Exposure | Red Filter | Green Filter | Blue Filter |
| Blue and Green | 1.52 | 0.72 | 0.58 |
| Red and Blue | 0.08 | 1.04 | 0.78 |
| Red and Green | 0.09 | 0.14 | 1.44 |

| Image-Receiving Element 20 | | | |
|---|---|---|---|
| | Density | | |
| Exposure | Red Filter | Green Filter | Blue Filter |
| Blue and Green | 1.59 | 0.81 | 0.50 |
| Red and Blue | 0.04 | 1.14 | 0.62 |
| Red and Green | 0.06 | 0.14 | 1.42 |

| Image-Receiving Element 21 | | | |
|---|---|---|---|
| | Density | | |
| Exposure | Red Filter | Green Filter | Blue Filter |
| Blue and Green | 1.11 | 0.52 | 0.33 |
| Red and Blue | 0.07 | 0.78 | 0.40 |
| Red and Green | 0.10 | 0.10 | 0.95 |

The result shown in the tables demonstrate that color images having improved density were obtained using the image-receiving elements of this invention.

While the invention has been described in detail and with reference to specific embodiments thereof, it will be apparent to one skilled in the art that various changes and modifications can be made therein without departing from the spirit and scope thereof.

What is claimed is:

1. In a color diffusion transfer process for forming transfer images which comprises the step of imagewise exposing a photosensitive element comprising a support having thereon at least one photosensitive silver halide emulsion layer and having associated with the silver halide in said photosensitive silver halide emulsion layer a dye image-forming material which provides a distribution of a diffusible dye corresponding to said imagewise exposure as the result of development of said photosensitive silver halide emulsion, processing said exposed photosensitive element with an aqueous alkaline solution, thereby forming an imagewise distribution of said diffusible dye and transferring at least partially to a superposed image-receiving layer to provide thereto a dye image, the improvement which comprises said image-receiving layer comprising a polymer mordant having therein at least one of the structural units represented by the general formula (I)

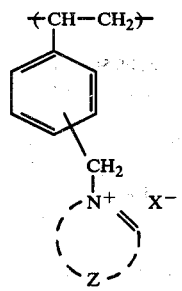

(I)

delocalized wherein Z represents the atomic group necessary for completing a nitrogen-containing unsaturated electron delocalized heterocyclic ring, and $X^-$ represents a monovalent anion; or represented by the general formula (II)

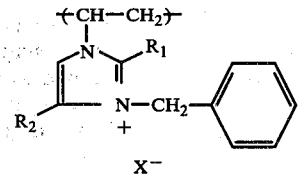

(II)

wherein $R_1$ and $R_2$ each represents a hydrogen atom, an alkyl group, a hydroxy alkyl group, or an aralkyl group, and $X^-$ represents a monovalent anion.

2. The color diffusion transfer process of claim 1, wherein said nitrogen-containing heterocyclic ring formed by Z is a pyridine ring, an β-picoline ring, a β-picoline ring, a γ-picoline ring, a 2-ethylpyridine ring, a 3-ethylpyridine ring, a 4-ethylpyridine ring, a 3-butylpyridine ring, a 3-benzylpyridine ring, a 4-α-phenylethylpyridine ring, a 4-β-(4-methoxyphenyl)ethylpyridine ring, a 4-β-(4-hydroxy-3-methoxyphenyl)ethylpyridine ring, a 3,5-lutidine ring, a 3-ethyl-4-methylpyridine ring, a quinoline ring, a 3-methylquinoline ring, a 3,4-dimethylquinoline ring, a 7-chloro-3-methylquinoline ring, a 2,4,6-trimethylquinoline ring, a 1,2-bis-(4-pyridyl)ethane ring, a 3-bromopyridine ring, 4-(p-chlorobenzyl)pyridine ring, γ-corydine ring, a 2,3,6-corydine ring, a 2,6-lutidine ring, a 3,4-lutidine ring, a 3,5-lutidine ring, 2,3-lutidine ring, a 2,4-lutidine ring, a 2,5-lutidine ring, a 2,5-dichloropyridine ring, a 4,4'-dipyridyl ring, a 4-phenylpyridine ring, an isoquinoline ring, a phenanthridine ring, a 4-methanolpyridine ring, a 3-acetylaminopyridine, 1,4-pyrimidine ring, a 1,2-pyrimidine ring, 1,3-pyrimidine ring, a 2-methyl-1,4-pyrimidine ring, a benzopyrimidine ring, an s-triazine ring, a 1,2-dimethylimidazole ring, a 1-ethyl-2-methylimidazole ring, a 2-methylbenzothiazole ring, or a 2-methylnaphthothiazole ring; wherein the alkyl group for $R_1$ or $R_2$ is a methyl group, an ethyl group, and an isopentyl group, propyl group, an isopropyl group, an n-butyl group, an iso-butyl group, an n-pentyl group, or an n-hexyl group; wherein the hydroxyalkyl group for $R_1$ and $R_2$ is a hydroxyethyl group, a hydroxypropyl group, a hydroxybutyl group, a hydroxypentyl group, a hydroxyhexyl group, a hydroxyoctyl group, or a hydroxydecyl group; wherein the aralkyl group for $R_1$ and $R_2$ is a benzyl group or a phenethyl group; and wherein X is a photographically inert ion selected from the group consisting of a chlorine ion, a bromine ion, an iodine ion, a nitrate ion, or an alkylsulfate ion.

3. The color diffusion transfer process of claim 1, wherein said polymer mordant contains therein the structural units represented by the general formula (I) or (II) in an amount of at least about 10 mole %.

4. The color diffusion transfer process of claim 1, wherein said polymer mordant has a molecular weight ranging from about 10,000 to 500,000.

5. The color diffusion transfer process of claim 1, wherein said polymer mordant contains therein the structural units represented by the general formula (II).

6. The color diffusion transfer process of claim 1, wherein said image-receiving layer is present on a support.

7. The color diffusion transfer process of claim 6, further including an acid polymer layer for neutralization between said image-receiving layer and the support thereof.

8. The color diffusion transfer process of claim 7, further including a neutralization controlling layer between said image-receiving layer and said acid polymer layer.

9. The color diffusion transfer process of claim 1, wherein said dye image-forming material is a dye developer or a diffusable dye releasing reducing agent.

10. The color diffusion transfer process of claim 1, wherein said dye image-forming material is a compound which couples with an oxidized product of an aromatic primary amino color developing agent to release a dye being soluble and diffusible in said aqueous alkaline solution, and said aqueous alkaline solution contains an aromatic primary amino color developing agent.

11. The color diffusion transfer process of claim 1 wherein a polymer mordant of structural unit represented by the general formula (I) is used as said polymer mordant of said image-receiving layer, said structural unit having the formula:

Polymer 1-1:

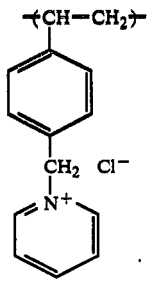

12. The color transfer process of claim 1 wherein a polymer mordant of the structural unit represented by the general formula (I) is used as said polymer mordant of said image-receiving layer, said structural unit having the formula:

Polymer I-2:

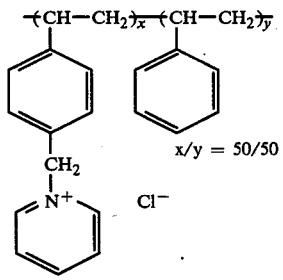

13. The color diffusion transfer process of claim 1 wherein a polymer mordant of the structural unit represented by the general formula (I) is used as said polymer mordant of said image-receiving layer, said structural unit having the formula:

Polymer I-3:

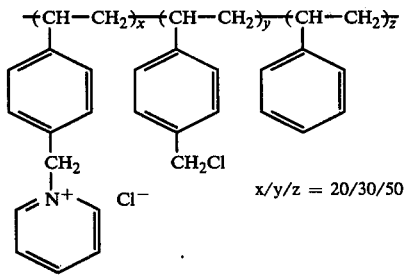

14. The color diffusion transfer process of claim 1 wherein a polymer mordant of the structural unit represented by the general formula (I) is used as said polymer mordant of said image-receiving layer, said structural unit having the formula:

Polymer I-4:

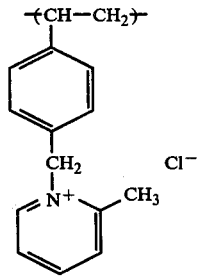

15. The color diffusion transfer process of claim 1 wherein a polymer mordant of the structural unit represented by the general formula (I) is used as said polymer mordant of said image-receiving layer, said structural unit having the formula:

Polymer I-5

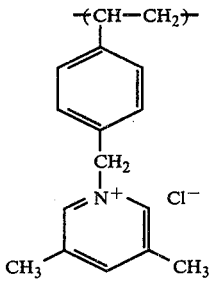

16. The color diffusion transfer process of claim 1 wherein a polymer mordant of the structural unit represented by the general formula (I) is used as said polymer mordant of said image-receiving layer, said structural unit having the formula:

Polymer I-6

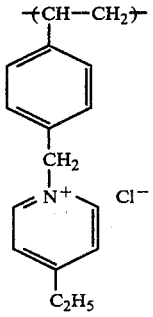

17. The color diffusion transfer process of claim 1 wherein a polymer mordant of the structural unit represented by the general formula (I) is used as said polymer mordant of said image-receiving layer, said structural unit having the formula:

Polymer I-7:

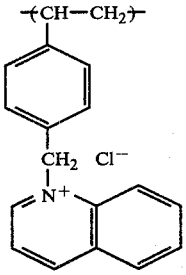

18. The color diffusion transfer process of claim 1 wherein a polymer mordant of the structural unit represented by the general formula (I) is used as said polymer mordant of said image-receiving layer, said structural unit having the formula:

Polymer I-8:

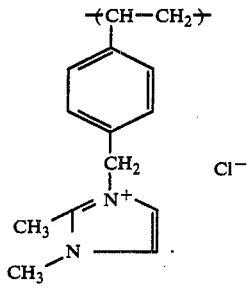

19. The color diffusion transfer process of claim 1 wherein a polymer mordant of the structural unit represented by the general formula (I) is used as said polymer mordant of said image-receiving layer, said structural unit having the formula:

Polymer I-9:

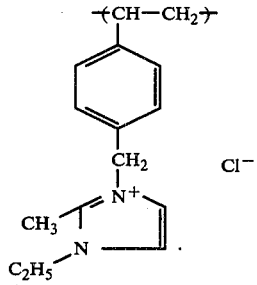

20. The color diffusion transfer process of claim 1 herein a polymer mordant of the structural unit represented by the general formula (I) is used, as said polymer mordant of said image-receiving layer, said structural unit having the formula:

Polymer I-10:

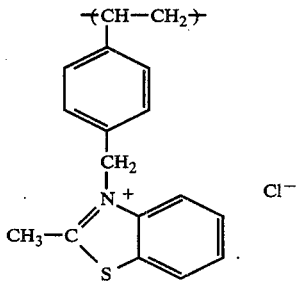

21. The color diffusion transfer process of claim 1 wherein a polymer mordant of the structural unit represented by the general formula (II) is used as said polymer mordant of said image-receiving layer, said structural unit having the formula:

Polymer II-1:

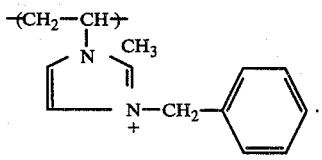

22. The color diffusion transfer process of claim 1 wherein a polymer mordant of the structural unit represented by the general formula (II) is used, as said polymer mordant of said image-receiving layer, said structural unit having the formula:

Polymer II-2:

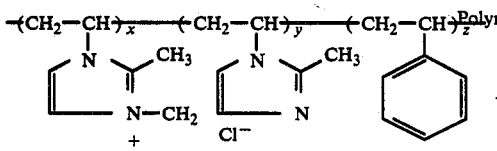

x/y/z=20/30/50 .

23. The color diffusion transfer process of claim 1 wherein a polymer mordant of the structural unit represented by the general formula (II) is used as said polymer mordant of said image-receiving layer, said structural unit having the formula:

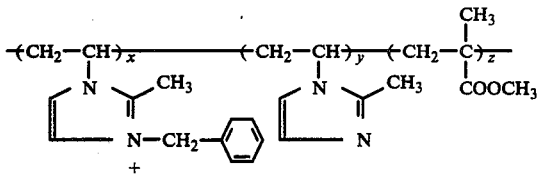

x/y/z=30/30/40 .

24. The color diffusion transfer process of claim 1 wherein a polymer mordant of the structural unit represented by the general formula (II) is used as said polymer mordant of said image-receiving layer, said structural unit having the formula:

Polymer II-4:

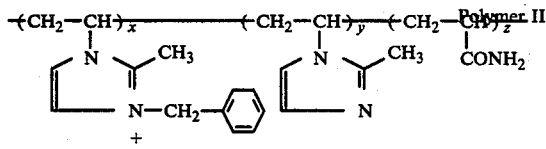

x/y/z=40/40/20 .

25. The color diffusion transfer process of claim 1 wherein a polymer mordant of the structural unit represented by the general formula (II) is used as said polymer mordant of said image-receiving layer, said structural unit having the formula:

Polymer II-5:

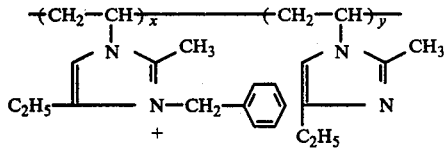

x/y=30/70 .

26. The color diffusion transfer process of claim 1 wherein a polymer mordant of the structural unit represented by the general formula (II) is used as said polymer mordant of said image-receiving layer, said structural unit having the formula:

Polymer II-6:

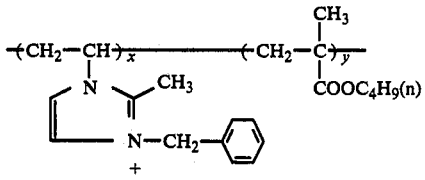

x/y=40/60 .

27. The color diffusion transfer process of claim 1 wherein a polymer mordant of the structural unit represented by the general formula (II) is used as said polymer mordant of said image-receiving layer, said structural unit having the formula:

Polymer II-7:

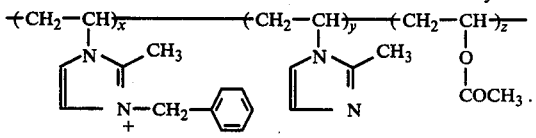

x/y/z = 30/50/20

28. The color diffusion transfer process of claim 1 wherein a polymer mordant of the structural unit represented by the general formula (II) is used as said polymer mordant of said image-receiving layer, said structural unit having the formula:

Polymer II-8:

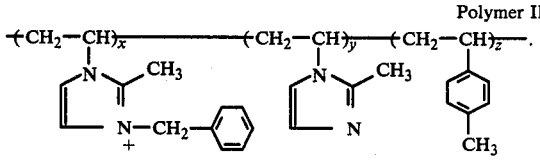

x/y/z = 20/50/30

29. The color diffusion transfer process of claim 1 wherein a polymer mordant of the structural unit represented by the general formula (II) is used as said polymer mordant of said image-receiving layer, said structural unit having the formula:

Polymer II-9:

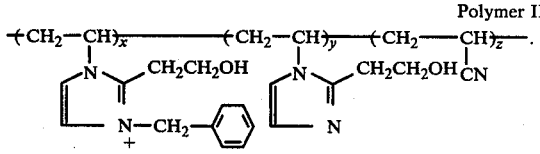

x/y/z = 30/20/50

30. The color diffusion transfer process of claim 1 wherein a polymer mordant of the structural unit represented by the general formula (II) is used as said polymer mordant of said image-receiving layer, said structural unit having the formula:

Polymer II-10:

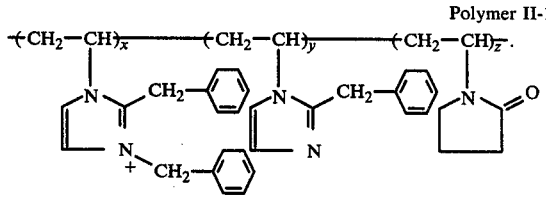

x/y/z = 10/20/70

* * * * *